US010821727B2

(12) United States Patent
Abe

(10) Patent No.: US 10,821,727 B2
(45) Date of Patent: Nov. 3, 2020

(54) LIQUID EJECTING APPARATUS AND DRIVE CIRCUIT

(71) Applicant: Seiko Epson Corporation, Tokyo (JP)

(72) Inventor: Akira Abe, Matsumoto (JP)

(73) Assignee: Seiko Epson Corporation (JP)

( * ) Notice: Subject to any disclaimer, the term of this patent is extended or adjusted under 35 U.S.C. 154(b) by 2 days.

(21) Appl. No.: 16/203,854

(22) Filed: Nov. 29, 2018

(65) Prior Publication Data

US 2019/0160812 A1 May 30, 2019

(30) Foreign Application Priority Data

Nov. 30, 2017 (JP) ..... 2017-230569

(51) Int. Cl.
*B41J 2/045* (2006.01)

(52) U.S. Cl.
CPC ..... *B41J 2/04581* (2013.01); *B41J 2/04541* (2013.01); *B41J 2/04588* (2013.01); *B41J 2/04593* (2013.01); *B41J 2/04596* (2013.01); *B41J 2202/13* (2013.01)

(58) Field of Classification Search
CPC ..... B41J 2/04581; B41J 2/04596; B41J 2/04541; B41J 2/04593; B41J 2/04588; B41J 2202/13
See application file for complete search history.

(56) References Cited

U.S. PATENT DOCUMENTS

2009/0206888 A1 8/2009 Kitazawa et al.
2017/0246862 A1 8/2017 Abe
2018/0093474 A1* 4/2018 Kawamoto ..... B41J 2/04588

FOREIGN PATENT DOCUMENTS

JP 2009-190287 A 8/2009
JP 2010-114711 A 5/2010
JP 2013-038458 A 2/2013
JP 2017-149071 A 8/2017

* cited by examiner

*Primary Examiner* — Geoffrey S Mruk
(74) *Attorney, Agent, or Firm* — Harness, Dickey & Pierce, P.L.C.

(57) ABSTRACT

Provided a liquid ejecting apparatus including: a head that includes a piezoelectric element which is displaced by application of a drive signal; a transistor pair that includes a high-side transistor and a low-side transistor and outputs the drive signal; and a control signal generation circuit which generates a first control signal that controls switching operation of the high-side transistor and a second control signal that controls switching operation of the low-side transistor, in which the high-side transistor is set to be on and thus a voltage of the drive signal rises, and the low-side transistor is set to be on and thus the voltage of the drive signal drops, and in which the control signal generation circuit generates the first control signal and the second control signal in such a manner that the high-side transistor and the low-side transistor are alternately set to be on.

7 Claims, 18 Drawing Sheets

| (SIH, SIL) | T1 | | T2 | |
|---|---|---|---|---|
| | Sa | Sb | Sa | Sb |
| (1, 1) [LARGE-SIZED DOT] | H | L | H | L |
| (1, 0) [MEDIUM-SIZED DOT] | H | L | L | H |
| (0, 1) [SMALL-SIZED DOT] | L | L | L | H |
| (0, 0) [NON-RECORDING] | L | H | L | L |

LIQUID EJECTING APPARATUS AND DRIVE CIRCUIT

The entire disclosure of Japanese Patent Application No. 2017-230569, filed Nov. 30, 2017 is expressly incorporated by reference herein.

BACKGROUND

1. Technical Field

The present invention relates to a liquid ejecting apparatus and a drive circuit.

2. Related Art

It is known that a piezoelectric element is used for a liquid ejecting apparatus, such as an ink jet printer, that ejects ink and thus prints an image or a document. Piezoelectric elements are provided in a manner that corresponds to a plurality of nozzles, respectively, in a head unit (an ink jet head), and each piezoelectric element is driven according to a drive signal. Thus, a given amount of ink (liquid) is ejected through a nozzle at a given timing and a dot is formed. Because the piezoelectric element is a capacitive load such as a capacitor from the electrical perspective, there is a need to supply a sufficient amount of current for operating the piezoelectric element for each nozzle.

For this reason, in the above-described liquid ejecting apparatus, a configuration is employed in which a drive signal that results from amplifying a source drive signal that is a source of a drive signal, in an amplification circuit is supplied to the head unit, and thus the piezoelectric element is driven. As a function of a drive circuit that generates the drive signal, an example is given in which the source drive signal is current-amplified in an AB grade amplifier (refer to JP-A-2009-190287). However, because the energy efficiency of a scheme for amplifying current is poor, in recent years, a D grade amplification scheme has been proposed in which switching operation of a transistor pair which is configured with a high-side transistor and a low-side transistor is controlled based on a modulation signal which results from performs a pulse width modulation or a pulse density modulation on the source drive signal, and in which the source drive signal is amplified by filtering an output signal of the transistor pair with a low pass filter (refer to JP-A-2010-114711). In the D grade amplification scheme, the energy efficiency is high compared with a linear amplification scheme, but power consumed by the low pass filter cannot be ignored. Because of this, a new-type drive circuit that reduces power consumption is proposed (refer to JP-A-2017-149071). As illustrated in FIG. 19, in the drive circuit that is disclosed in JP-A-2017-149071, a comparator compares a voltage of a drive signal COM and a voltage of a source drive signal Vin. When a control signal OC is at a high level, a control signal Gt1 is at a high level and an output signal of the comparator is selected as a control signal Gt2 by a selector. When the control signal OC is at a low level, the output signal of the comparator is selected as the control signal Gt1 by the selector and the control signal Gt2 is at the low level. During a duration during which the voltage of the source drive signal Vin drops and a duration subsequent to this duration, during which a voltage is constant, the control signal OC is at a high level. During a duration during which the voltage of the source drive signal Vin rises and a duration subsequent to this duration, during which a voltage is constant, the control signal OC is at a low level. The control signal Gt1 is input into a gate of a high-side transistor (a P channel-type MOS transistor), and the control signal Gt2 is input into a gate of a low-side transistor (an N channel-type MOS transistor). Then, a capacitor connected between an output terminal of a transistor pair that is configured with the high-side transistor and the low-side transistor and the ground, a signal from the output terminal is a drive signal COM. Therefore, when the control signal OC is at the high level, the high-side transistor is set to be off and, only when the output signal of the comparator is at a high level (when the voltage of the drive signal COM is higher than the voltage of the source drive signal Vin), the low-side transistor is set to be on. Thus, current flows from the capacitor to the ground through the low-side transistor, and the voltage of the drive signal COM drops. On the other hand, when the control signal OC is at the low level, the low-side transistor is set to be off, and only when the output signal of the comparator is at a low level (when the voltage of the drive signal COM is lower than the voltage of the source drive signal Vin), the high-side transistor is set to be on. Thus, current flows from a power source to the capacitor through the high-side transistor, and the voltage of the drive signal COM rises. In this manner, the voltage of the drive signal COM is similar to the voltage of the source drive signal Vin. In the drive circuit, the low pass filter is unnecessary and during a duration during which the voltage of the source drive signal Vin rises or a duration during which the voltage of the source drive signal Vin drops, only one of the high-side transistor and the low-side transistor performs a switching operation. Because of this, it is possible that less power is consumed than a D grade type drive circuit.

However, in recent years, there has been a high demand for high-speed printing or high-resolution printing. In order to satisfy the demand, there is a need to greatly increase the number of nozzles (the number of piezoelectric elements). As a result, the number of piezoelectric elements that are driven at the same time are also greatly increased. In this case, as illustrated in FIG. 20, an amount of load current I that flows between the drive circuit and a piezoelectric element group that is a capacitive load on the drive circuit increases greatly, but parasitic inductance Ls of an FFC cable or a substrate cable is present between the drive circuit and the piezoelectric element group. Because of this, a large amount of noise, which is in proportion to the product ($Ls \times dI/dt$) of the parasitic inductance and a change rate of the load current I, is superimposed on the drive signal COM and high ripple occurs. Furthermore, because the parasitic inductance Ls also has an influence on the load current I, during a duration during which the voltage of the source drive signal Vin is constant, the load current I does not immediately approach zero, and transitions to the duration during which the voltage of the source drive signal Vin rises or the duration during which the voltage of the source drive signal Vin drops, with errors $\Delta V1$ and $\Delta V2$ occurring in the voltage of the drive signal COM and the voltage of the source drive signal Vin. That is, the larger the amount of load current I, the higher the ripple in the drive signal COM and the greater the errors $\Delta V1$ and $\Delta V2$ in the voltage of the source drive signal Vin. Because of this, the precision of the waveform of the drive signal COM decreases, and the precision of ejecting liquid decreases. Therefore, the drive circuit that is disclosed in JP-A-2017-149071 is not suitable for heavy load drive.

SUMMARY

An advantage of some aspects of the invention is that a liquid ejecting apparatus can be provided that is capable of providing a greater improvement in the precision of ejecting liquid than in related art. Furthermore, an advantage of some aspects of the invention is that a drive circuit can be provided that is capable of generating a drive signal with higher precision of a waveform than in the related art.

The invention can be realized in the following aspects or application examples.

Application Example 1

According to this application example, there is provided a liquid ejecting apparatus including: a head that includes a nozzle and a piezoelectric element which is displaced by application of a drive signal, and that ejects liquid through the nozzle by the displacement of the piezoelectric element; a comparator that compares a voltage of a source drive signal which is a source of the drive signal and a voltage of a feedback signal which is a signal that results from feeding back the drive signal; a transistor pair that includes a high-side transistor and a low-side transistor and outputs the drive signal; and a control signal generation circuit into which an output signal of the comparator is input and which generates a first control signal that controls switching operation of the high-side transistor and a second control signal that controls switching operation of the low-side transistor, in which the high-side transistor is set to be on and thus a voltage of the drive signal rises, and the low-side transistor is set to be on and thus the voltage of the drive signal drops, and in which the control signal generation circuit generates the first control signal and the second control signal in such a manner that the high-side transistor and the low-side transistor are alternately set to be on.

The liquid ejecting apparatus according to the application example may further include a D/A conversion circuit that converts a digital signal that stipulates a waveform of the drive signal, into a source drive signal that is an analog signal.

The first feedback signal may be a signal that results from feeding back the drive signal as is, and may be a signal that results from attenuating and feeding back the drive signal.

In the liquid ejecting apparatus according to the application example, based on a result of comparing the voltage of the source drive signal and the voltage of the feedback signal that results from feeding back the drive signal, the high-side transistor and the low-side transistor are alternately set to be on, and thus the rise and drop in the voltage of the drive signal are alternately repeated. That is, when the voltage of the feedback signal is higher than the voltage of the source drive signal, the low-side transistor is promptly set to be on and thus the voltage of the drive signal drops. Furthermore, when the voltage of the feedback signal is lower than the voltage of the source drive signal, the high-side transistor is promptly set to be on and thus the voltage of the drive signal COMA rises. Therefore, with the liquid ejecting apparatus according to the present application example, because the similarity of the voltage of the drive signal to the voltage of the source drive signal is high, the precision of the waveform of the drive signal can be improved and the precision of ejecting liquid can be improved.

Application Example 2

In the liquid ejecting apparatus according to the application example, during a duration during which the voltage of the source drive signal rises, the high-side transistor and the low-side transistor may be alternately set to be on.

In the liquid ejecting apparatus according to the application example, when the voltage of the drive signal arises with the voltage of the source drive signal, if the voltage of the feedback signal is higher than the voltage of the source drive signal, the voltage of the drive signal promptly stops rising and starts to drop. Furthermore, if the voltage of the feedback signal is lower than the voltage of the source drive signal, the voltage of the drive signal promptly stops dropping and starts to rise. Because of this, ripple that occurs in the drive signal is reduced. Therefore, with the liquid ejecting apparatus according to the present application example, the precision of the waveform of the drive signal can be improved and the precision of ejecting liquid can be improved.

Application Example 3

In the liquid ejecting apparatus according to the application example, during a duration during which the voltage of the source drive signal drops, the high-side transistor and the low-side transistor may be alternately set to be on.

In the liquid ejecting apparatus according to the application example, when the voltage of the drive signal drops with the voltage of the source drive signal, if the voltage of the feedback signal is lower than the voltage of the source drive signal, the voltage of the drive signal promptly stops dropping and starts to rise. Furthermore, if the voltage of the feedback signal is higher than the voltage of the source drive signal, the voltage of the drive signal promptly stops rising and starts to drop. Because of this, a size of the ripple that occurs in the drive signal is reduced. Therefore, with the liquid ejecting apparatus according to the present application example, the precision of the waveform of the drive signal can be improved and the precision of ejecting liquid can be improved.

Application Example 4

In the liquid ejecting apparatus according to the application example, during a duration during which the voltage of the source drive signal is constant, the high-side transistor and the low-side transistor may be alternately set to be on.

In the liquid ejecting apparatus according to the present application example, when the voltage of the source drive signal is at a constant voltage, the voltage of the feedback signal is higher than the voltage of the source drive signal, the voltage of the drive signal promptly stops rising and starts to drop. Furthermore, if the voltage of the feedback signal is lower than the voltage of the source drive signal, the voltage of the drive signal promptly stops dropping and starts to rise. Because of this, an error in a desired voltage in accordance with the voltage of the drive signal and the voltage of the source drive signal is reduced. Therefore, with the liquid ejecting apparatus according to the present application example, the precision of the waveform of the drive signal can be improved and the precision of ejecting liquid can be improved.

Application Example 5

In the liquid ejecting apparatus according to the application example, the head may include 600 or more nozzles that are arranged side by side at a density of 300 or more nozzles per one inch.

In a case where the head includes the 600 or more nozzles that are arranged side by side at a density of 300 or more nozzles per one inch, a load capacity of the drive circuit increases and thus the load current I increase. Because of this, there arises a situation where an amount of noise, which is in proportion to the product (Ls×dI/dt) of parasitic inductance Ls and a change rate of load current I, is superimposed onto the drive signal, and where high ripple easily occurs. In contrast, in the liquid ejecting apparatus according to the present application example, during a duration during which the voltage of the source drive signal rises or drops, the similarity of the voltage of the drive signal to the voltage of the source drive signal is also high. Because of this, although a load capacity Cz increases, the size of the ripple that occurs on the drive signal can be kept small. Therefore, with the liquid ejecting apparatus according to the present application example, for example, in a case where printing at a high resolution is performed, the precision of the waveform of the drive signal can also be improved and the precision of ejecting liquid can also be improved.

Application Example 6

In the liquid ejecting apparatus according to the application example, the head may eject the liquid through the nozzle at frequencies of 30 or more kHz.

In a case where the head ejects liquid through the nozzle at frequencies of 30 or more kHz, a periodicity the drive signal has to be short. Because of this, each duration during which the voltage of the source drive signal is constant needs to be shortened. In contrast, with the liquid ejecting apparatus according to the present application example, because the similarity of the voltage of the drive signal to the voltage of the source drive signal is high, although each duration during which the voltage of the source drive signal is constant is short, an error in a desired voltage in accordance with the voltage of the drive signal and the voltage of the source drive signal decreases reliably until when a voltage starts to rise or drop shortly thereafter. Therefore, with the liquid ejecting apparatus according to the present application example, for example, in a case where high-speed printing is performed, the precision of the waveform of the drive signal can also be improved and the precision of ejecting liquid can also be improved.

Application Example 7

In the liquid ejecting apparatus according to the application example, the source drive signal may have a waveform that has four or more durations during which a voltage is constant, and the head may eject the liquid one time by applying a drive waveform which corresponds to the waveform of the source drive signal to the piezoelectric element.

For example, in a case where the head ejects high-viscosity liquid, a rear end portion of the ejected liquid extends like a tail. Because of this, the source drive signal that is a source of the drive signal which has a drive waveform for cutting off the tail has many durations during which a voltage is constant, and as a result, a duration during which the voltage of the source drive signal is constant is shortened. In contrast, with the liquid ejecting apparatus according to the present application example, because the similarity of the voltage of the drive signal to the voltage of the source drive signal is high, although each duration during which the voltage of the source drive signal is constant is short, an error in a desired voltage in accordance with the voltage of the drive signal and the voltage of the source drive signal decreases reliably until when a voltage starts to rise or drop shortly thereafter. Therefore, with the liquid ejecting apparatus according to the present application example, for example, in a case where high-viscosity printing is performed, the precision of the waveform of the drive signal can also be improved and the precision of ejecting liquid can also be improved.

Application Example 8

According to this application example, there is provided a drive circuit that generates a drive signal which is to be applied to a piezoelectric element of a head that ejects liquid through a nozzle with displacement of the piezoelectric element, the drive circuit including: a comparator that compares a voltage of a source drive signal which is a source of the drive signal and a voltage of a feedback signal which is a signal that results from feeding back the drive signal; a transistor pair that includes a high-side transistor and a low-side transistor and outputs the drive signal; and a control signal generation circuit into which an output signal of the comparator is input and which generates a first control signal that controls switching operation of the high-side transistor and a second control signal that controls switching operation of the low-side transistor, in which the control signal generation circuit includes an OR circuit which has a first input terminal and a second input terminal, into the first input terminal and the second input terminal of which the output signal of the comparator is input, and which outputs the first control signal, and an AND circuit which has a third input terminal and a fourth input terminal, into the third input terminal and the fourth input terminal of which the output signal of the comparator is input, and which outputs the second control signal, and in which a logical threshold of the OR circuit is lower than a logical threshold of the AND circuit.

In the drive circuit according to the application example, when the voltage of the feedback signal is higher than the voltage of the source drive signal, the first control signal and the second control signal are both at the high level. Because of this, the high-side transistor is promptly set to be off and the low-side transistor is set to be off and thus the voltage of the drive signal drops. Furthermore, when the voltage of the feedback signal is lower than the voltage of the source drive signal, the first control signal and the second control signal are both at the low level. Because of this, the high-side transistor is promptly set to be on and the low-side transistor is set to be on and thus the voltage of the drive signal rises. Therefore, with the drive circuit according to the present application example, because the similarity of the voltage of the drive signal to the voltage of the source drive signal is high, the drive signal with higher precision of a waveform can be generated.

Furthermore, in the drive circuit according to the application example, because the logical threshold of the OR circuit is lower than the logical threshold of the AND circuit, when the output signal of the comparator changes from the low level to the high level, the OR circuit operates at a higher speed than the AND circuit. Because of this, a length of time for which the first control signal is on the rising edge is shorter than a length f time for which the second control signal VN is on the rising edge. Conversely, when the output signal of the comparator changes from the high level to the low level, the AND circuit operates at a higher speed than the OR circuit. Because of this, a length of time for which the second control signal is on the falling edge is shorter than a length of time for which the first control signal is on the falling edge. For this reason, a state is not attained where the first control signal is at the low level and the second control signal at the high level, and thus there is a decreased concern that the high-side transistor and the low-side transistor will be both set to be on and that a large amount of through-current will flow.

BRIEF DESCRIPTION OF THE DRAWINGS

The invention will be described with reference to the accompanying drawings, wherein like numbers reference like elements.

DESCRIPTION OF EXEMPLARY EMBODIMENTS

Suitable embodiments of the invention will be described in detail below. For convenience of description, the drawings are referred to. It is noted that the embodiments which will be described below do not improperly limit the subject matters of the invention, which are recited in claims. Furthermore, all configurations that will be described below are not necessarily essential requirements for the invention.

1. Outline of a Liquid Ejecting Apparatus

A liquid ejecting apparatus according to the present embodiment is an ink jet printer that discharges ink onto image data which is supplied from an external host computer and thus forms an ink dot group on a printing medium such as a paper sheet, thereby printing an image (including a letter, a figure, and the like) in accordance with the image data.

Figure 1:
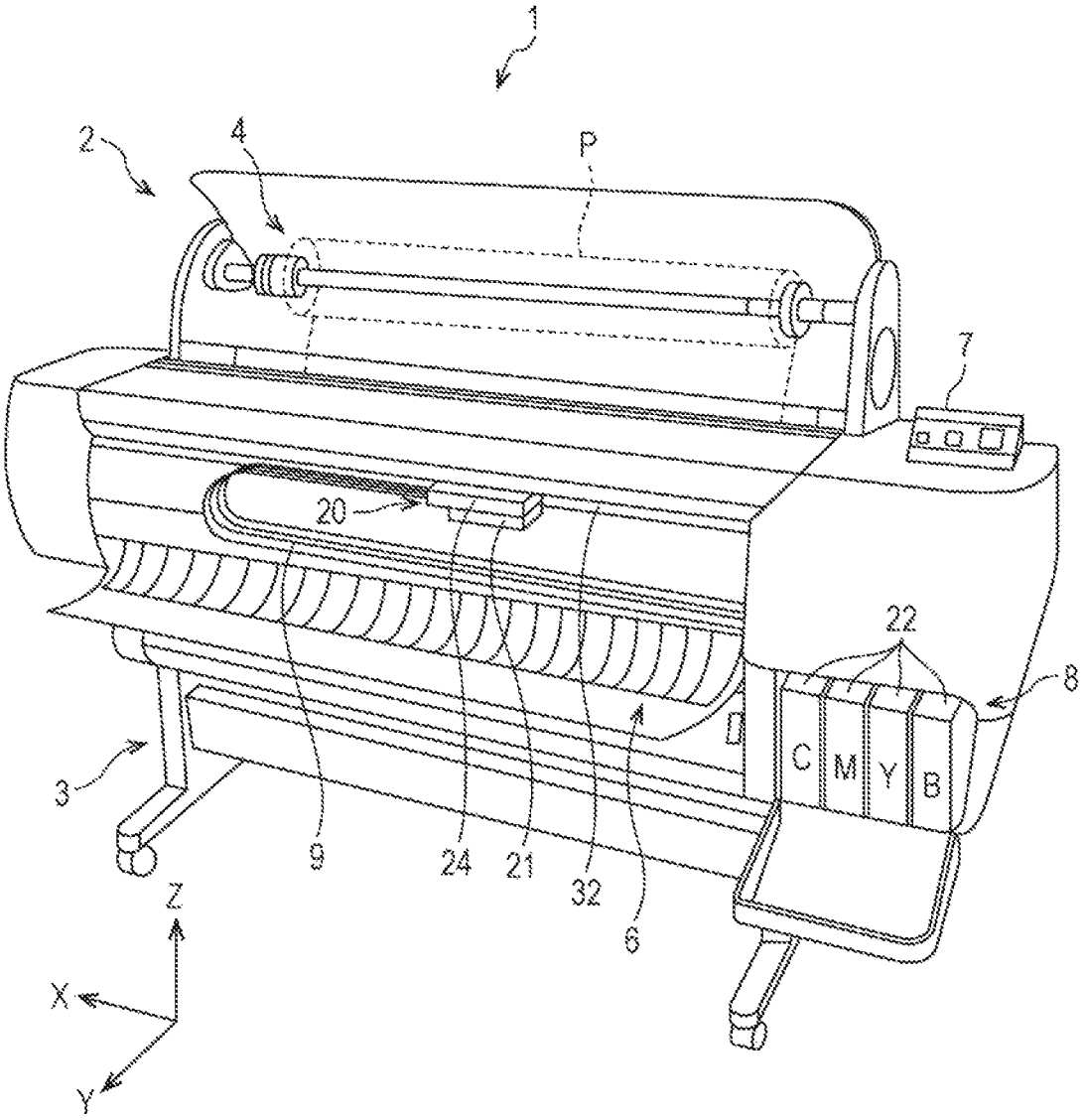
FIG. 1 is a schematic diagram illustrating an external appearance of a liquid ejecting apparatus.

FIG. 1 is a schematic diagram illustrating an external appearance of a liquid ejecting apparatus 1 according to the present embodiment. As described in FIG. 1, the liquid ejecting apparatus 1 according to the present embodiment is a liquid ejecting apparatus that is a serial scanning type (a serial printing type), and includes a main body 2 and a support stand 3 that supports the main body 2. The liquid ejecting apparatus 1 according to the present embodiment is a large format printer that possibly performs serial printing on a medium (a printing medium) having a width that is equal to or larger than an A3 short-side width (297 mm), in other words, a printer that possibly performs the serial printing to a printing width that is equal or larger than the A3 short-side width (297 mm). However, the liquid ejecting apparatus 1 may not be necessarily a large format printer. It is noted that, in the present embodiment, in the liquid ejecting apparatus 1, a moving direction of a carriage 24, a transportation direction of a printing medium P, and a vertical direction are defined as a main scanning direction X, a sub-scanning direction Y, and Z, respectively, for the convenience of providing description. Furthermore, the main scanning direction X, the sub-scanning direction Y, and the vertical direction Z are illustrated, in the drawings, as three axes that orthogonally intersect each other, but a relationship in arrangement for each configuration is not necessarily limited to the orthogonal intersection.

As illustrated in FIG. 1, the main body 2 of the liquid ejecting apparatus 1 includes a supply section 4 that supplies the printing medium P (for example, a roller paper sheet), a head unit 20 that ejects an ink droplet onto the printing medium P and performs printing on the printing medium P, a discharge section 6 that discharge the printing medium, the printing on which is performed by the head unit 20, is discharged outside the main body 2, an operation section 7 that performs operations of performing and stopping the printing and so forth, and an ink storage section 8 in which ink (liquid) to be ejected is stored. Furthermore, although not illustrated, a USB port and a power source port are installed on the rear surface of the liquid ejecting apparatus 1. That is, the liquid ejecting apparatus 1 is configured in such a manner as to connectable to a computer or the like through the USB port.

The head unit 20 is configured to include the carriage 24, and a head 21 that is mounted on the carriage in such a manner as to face the printing medium (the roller paper sheet) P.

Figure 2:
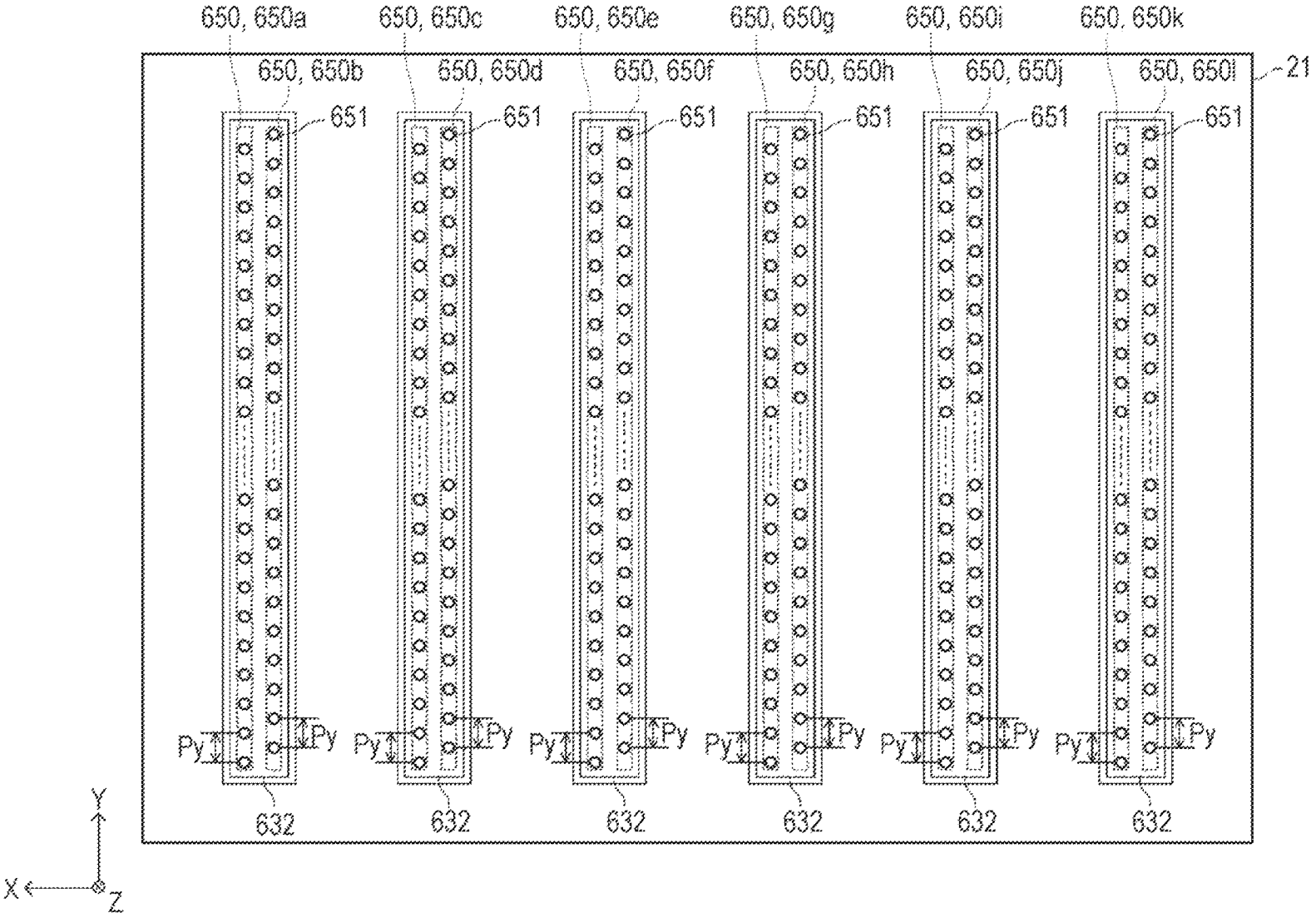
FIG. 2 is a diagram illustrating a lower surface (an ink ejection surface) of a head.

The head 21 is a liquid ejecting head for ejecting ink droplets (droplets of liquid) through many nozzles 651 (refer to FIG. 2). In the present embodiment, the head 21 includes 600 or more nozzles 651 that are arranged side by side at a density of 300 or more nozzles per one inch, and one piezoelectric element 60 (refer to FIGS. 4 and 5) that is a driving element for ejecting liquid is provided for each nozzle 651. Then, in the head 21, application of a drive signal to the piezoelectric element 60 causes the piezoelectric element 60 to be displaced, and the displaced piezoelectric element 60 causes ink (liquid) to be ejected through the nozzle 651.

FIG. 2 is a diagram illustrating a lower surface (an ink ejection surface) of the head 21. As illustrated in FIG. 2, six nozzle plates 632, each of which has two nozzle columns 650, each of which has many nozzles 651 that are lined up one behind another with a predetermined pitch along the sub-scanning direction Y, are provided to be lined up one behind another along the main scanning direction X on the ink ejection surface of the head 21. Between two nozzles columns 650 that are provided in each nozzle plate 632, a relationship is established in which each nozzle 651 is shifted by half the pitch Py in the sub-scanning direction Y. In this manner, in the present embodiment, 12 nozzle columns 650 (a first nozzle column 650*a* to a twelfth nozzle column 6501) are provided on the ink ejection surface of the head 21.

The carriage 24 is supported by a carriage guide shaft 32 and moves (reciprocates) in the main scanning direction X. At this time, the printing medium P is transported in the sub-scanning direction Y. That is, in the liquid ejecting apparatus 1 according to the present embodiment, the head unit 20, which includes the carriage 24 that is equipped with the head 21 through which to eject an ink droplet, performs a serial printing operation of printing while moving (reciprocating) in the main scanning direction X.

A plurality of ink cartridges 22 are attached to the ink storage section 8. Each ink cartridge 22 is filled with ink having corresponding color. In FIG. 1, four ink cartridges that correspond to four colors, cyanogen (C), magenta (M), yellow (Y), black (B), respectively, are illustrated, but the ink cartridge 22 is not limited to the present configuration, and for example, the ink storage section 8 may include five or more ink cartridges 22, and may include ink cartridges 22 that correspond to gray, green, violet, and the like, respectively, in color. The ink that is accommodated in the ink cartridge 22 is supplied to the head 21 through an ink tube 9. It is noted that, in the liquid ejecting apparatus 1, a plurality of ink cartridge 22 are attached to the carriage 24.

Figure 3:
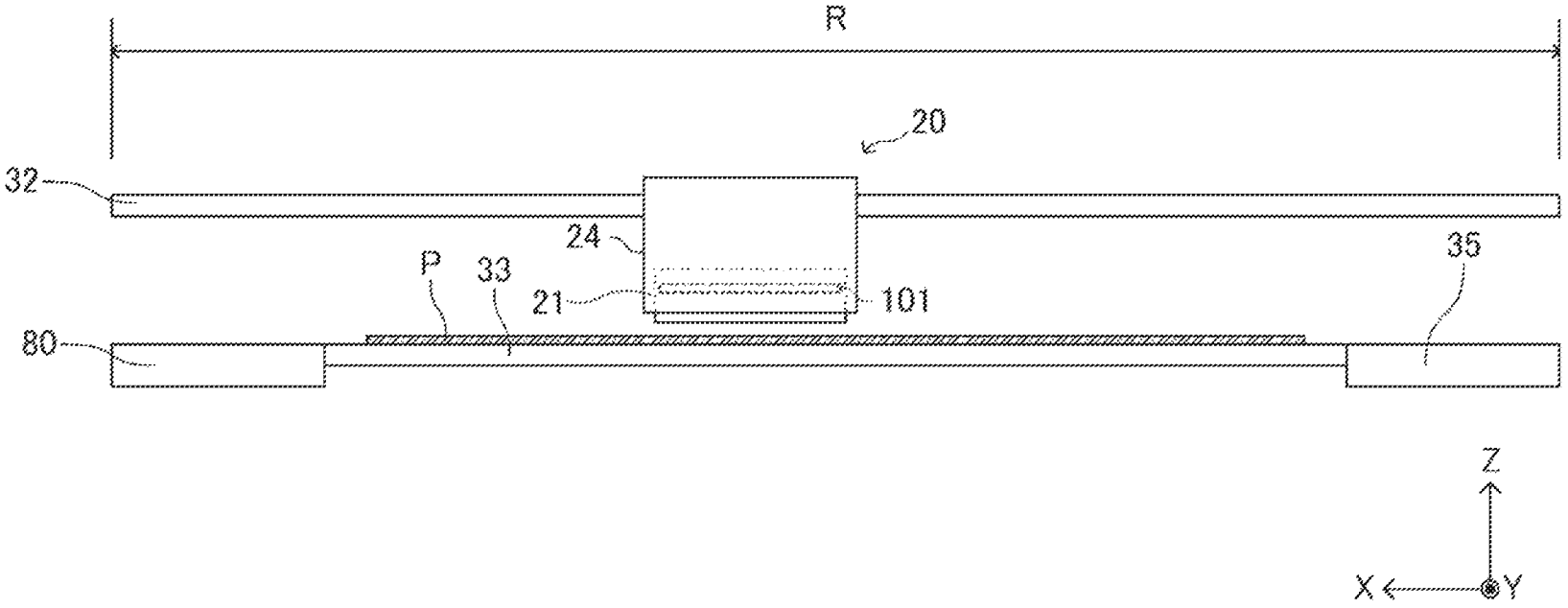
FIG. 3 is a diagram schematically illustrating an internal configuration of the liquid ejecting apparatus.

FIG. 3 is a diagram schematically illustrating an internal configuration that results when the liquid ejecting apparatus 1 is viewed from a minus direction (a direction opposite to a direction in which the printing medium P is transmitted from upstream to downstream) of the sub-scanning direction Y. As illustrated in FIG. 3, the liquid ejecting apparatus 1 includes the head unit 20, a carriage guide shaft 32, a platen 33, a capping mechanism 35, and a maintenance mechanism 80.

Under the control of a carriage moving mechanism that is not illustrated, the head unit 20 moves (reciprocates) within a range for an area R where a movement along the carriage guide shaft 32 is possible. A head substrate 101 is mounted on the head 21, and the ink ejection surface of the head 21 faces the printing medium P.

A roller that transports the printing medium P, which is not illustrated, is provided on the platen 33. The roller not only transports the printing medium P in the sub-scanning direction Y, but also holds the printing medium P when an ink droplet is ejected onto the printing medium P.

The capping mechanism 35, which seals a nozzle formation surface (the ink ejection surface) of the head 21, is provided in a home position that is a starting point for moving (reciprocating) the head unit 20. The home position is a position in which the head unit 20 is on standby when the liquid ejecting apparatus 1 does not perform the printing.

Furthermore, in the area R where the head unit 20 is movable, the maintenance mechanism 80 is provided in the remotest place from the home position. The maintenance mechanism 80 performs cleaning processing (pumping processing) that absorbs ink, a bubble, or the like, which thickens within the inside of an ejecting section 600, with a tube pump (not illustrated), or wiping processing that wipes off a foreign material, such as paper dust, that adheres to the vicinity of the nozzle, as maintenance processing.

2. ELECTRICAL CONFIGURATION OF THE LIQUID EJECTING APPARATUS

Figure 4:
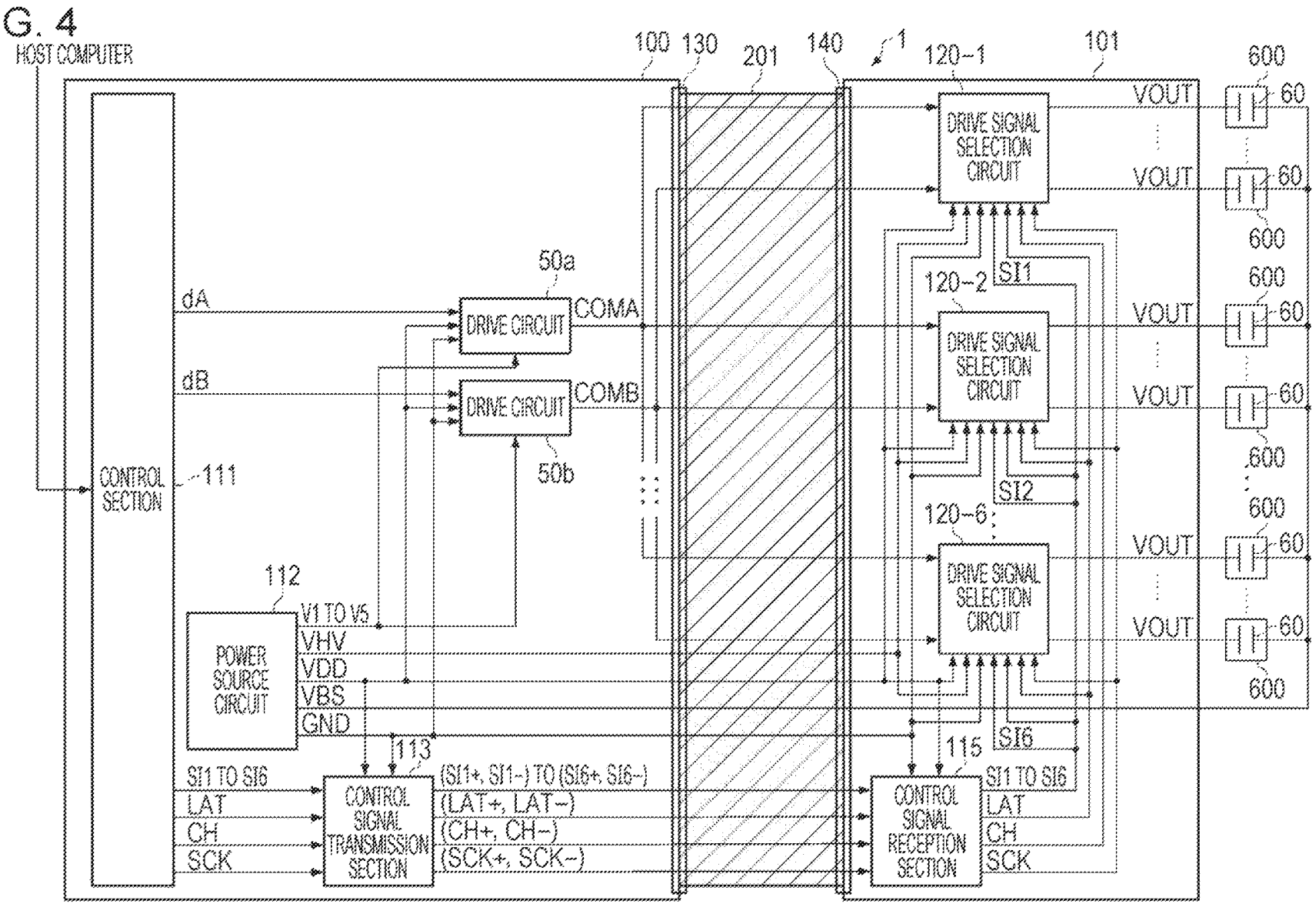
FIG. 4 is a block diagram illustrating an electrical configuration of the liquid ejecting apparatus.

FIG. 4 is a block diagram illustrating an electrical configuration of the liquid ejecting apparatus 1 according to the present embodiment. As illustrated in FIG. 4, the liquid ejecting apparatus 1 includes a control substrate 100 and the head substrate 101. The control substrate 100 is held fixed in a given place within the main body 2 (refer to FIG. 1), and the head substrate 101 is mounted on the carriage 24 of the head unit 20.

Provided (mounted) on the control substrate 100 are a control section 111, a power source circuit 112, a control signal transmission section 113, and drive circuits 50*a* and 50*b*. Furthermore, a connector 130 to which one terminal of a cable 201 is connected is provided on the control substrate 100.

The control section 111, for example, is realized with a processor such as a micro-processor, and, based on various signals, such as image data, that is supplied from the host computer, generates various pieces of data or signals.

Specifically, based on various signals from the host computer, the control section 111 generates drive data dA and drive data dB that are pieces of digital data which are sources of drive signals COMA and COMB, respectively, that drive each ejecting section 600 which is possessed by the head 21. The drive data dA is supplied to the drive circuit 50*a*, and the drive data dB is supplied to the drive circuit 50*b*. The drive data dA is digital data that stipulates a waveform of the drive signal COMA, and the drive data dB is digital data that stipulates a waveform of the drive signal COMB.

Furthermore, based on various signals from the host computer, the control section 111 generates six printing data signals, printing data signals SI1 to SI6, a latch signal LAT, a change signal CH, and a clock signal SCK, as a plurality of types of control signals that control liquid from each ejecting section 600, and outputs the generated signals to the control signal transmission section 113.

It is noted that in addition to the above-described processing, the control section 111 knows a scanning position of the carriage 24 (the head unit 20), and, based on the scanning position of the carriage 24, also performs processing that drives a carriage motor which is not illustrated. Accordingly, the movement of the carriage 24 in the main scanning direction X is controlled. Furthermore, the control section 111 performs processing that drives a transportation motor which is not illustrated. Accordingly, the movement of the printing medium P in the sub-scanning direction Y is controlled.

Moreover, the control section 111 causes the maintenance mechanism 80 (refer to FIG. 3) to perform the maintenance processing (the cleaning processing (the pumping processing) or the wiping processing) for restoring a state where the head 21 ejects ink to a normal state.

The power supply circuit 112 generates a constant high power source voltage VHV (for example, 42 V), a constant low power source voltage VDD (for example, 3.3 V), a constant offset voltage VBS (for example, 6 V), and a ground voltage GND (0 V). Moreover, the power supply circuit 112 generate five types of power source voltages, power source voltages V1 to V5, that are different from each other. The power source voltage V2 is higher than the power source voltage V1, the power source voltage V3 is higher than the power source voltage V2, the power source voltage V4 is higher than the power source voltage V3, and the power source voltage V5 is higher than the power source voltage V4. The power source voltage V1 is equal to or higher than the ground voltage GND, and the power source voltage V5 is equal to or lower than the high power source voltage VHV. It is hereinafter assumed that the power source voltage V1 is the same as the ground voltage GND (0 V), and that the power source voltage V5 is the same as the high power source voltage VHV (for example, 42 V). Furthermore, it is assumed that the power source voltages V2 to V4 are voltages (for example, 10.5 V, 21 V, and 31.5 V, respectively), that result from diving a difference in voltage between the high power source voltage VHV and the ground voltage GND by 4.

The control signal transmission section 113 operates by being supplied with the low power source voltage VDD and the ground voltage GND, and converts six printing data signals, the printing data signals SI1 to SI6, which are output from the control section 111, into differential signals (SI1+ and SI1−) to (SI6+ and SI6−), respectively. Furthermore, the control signal transmission section 113 converts the latch signal LAT, the change signal CH, and the clock signal SCK, which are output from the control section 111, into differential signals (LAT+, and LAT−), (CH+ and CH−), and (SCK+ and SCK−), respectively. The control signal transmission section 113, for example, generate a differential signal in compliance with a Low Voltage Differential Signaling (LVDS) transfer scheme. The differential signals in compliance with the LVDS transfer scheme can realize high speed data transfer because amplitude thereof is approximately 350 mV. It is noted that the control signal transmission section 113 may generate differential signals in compliance with various high speed transfer schemes, such as Low Voltage Positive Emitter Coupled Logic (LVPECL) and Current Mode Logic (CML) transfer schemes, in addition to the LVDS scheme.

The drive circuit 50*a* operates by being supplied with the low power source voltage VDD, the ground voltage GND, and the high source voltages V1 to V5, and, based on the drive data dA that is output from the control section 111, generates the drive signal COMA. Furthermore, the drive circuit 50*b* operates by being supplied with the low power source voltage VDD, the ground voltage GND, and the high source voltages V1 to V5, and, based on the drive data dB that is output from the control section 111, generates the drive signal COMB.

It is noted that the drive circuits 50*a* and 50*b* may employ the same circuit configuration except that only different pieces of drive data are input and only different drive signals are output, and that the detail thereof will be described below.

The drive signals COMA and COMB, which are generated by the drive circuits 50*a* and 50*b*, respectively, are transferred from the control substrate 100 to the head substrate 101 over the cable 201. Furthermore, the high power source VHV, the lower power source voltage VDD, the offset voltage VBS, the ground voltage GND, and the differential signals (SI1+ and SI1−) to (SI6+ and SI6−), (LAT+ and LAT−), (CH+ and CH−), and (SCK+ and SCK−) are also transferred from the control substrate 100 to the head substrate 101 over the cable 201. The cable 201, for example, may be a Flexible Flat Cable (FFC).

Provided (mounted) on the head substrate 101 are a control signal reception section 115 and six drive signal selection circuits, drive signal selection circuits 120-1 to 120-6. Furthermore, a connector 140 to which the other terminal of the cable 201 is connected is provided on the head substrate 101.

The control signal reception section 115 operates by being supplied with the low power source voltage VDD and the ground voltage GND, receives the differential signals (SI1+ and SI1−) to (SI6+ and SI6−), (LAT+ and LAT−), (CH+ and CH−), and (SCK+ and SCK−), in compliance with the LVDS transfer scheme, performs differential amplification on the received signals, and converts signals that results from the differential amplification into single-ended printing data signal SI1 to SI6, a latch signal LAT, a change signal CH, and a clock signal SCK, respectively. It is noted that the control signal reception section 115 may receive differential signals in compliance with various high speed transfer schemes, such as the LVPECL and CML transfer schemes, in addition to the LVDS transfer scheme.

Then, the printing data signals SI1 to SI6 are supplied to the drive signal selection circuits 120-1 to 120-6, respectively. Furthermore, the latch signal LAT, the change signal CH, and the clock signal SCK are supplied, in a shared manner, to the drive signal selection circuits 120-1 to 120-6.

The drive signal selection circuits 120-1 to 120-6 operate by being supplied with the high power source voltage VHV, the low power source voltage VDD, and the ground voltage GND, and outputs a drive signal VOUT to any one of a plurality of ejecting sections 600 that eject ink through a plurality of nozzles in the head 21. Specifically, based on the clock signal SCK, the printing data signal SI1 to SI6, the latch signal LAT, and the change signal CH, each of the drive signal selection circuits 120-1 to 120-6 selects any one of the drive signal COMA and the drive signal COMB, and outputs the drive signal VOUT, or sets an output to be at high impedance without making any selection. It is noted that the drive signal selection circuits 120-1 to 120-6 employs the same circuit configuration and the detail thereof will be described below.

The drive signal VOUT that is output by the drive signal selection circuits 120-1 is applied to one terminal of the piezoelectric element 60 that is possessed by each ejecting section 600 which is provided in a manner that corresponds to the first nozzle column 650*a* and the second nozzle columns 650*b*. Furthermore, the drive signal VOUT that is output by the drive signal selection circuit 120-2 is applied to one terminal of the piezoelectric element 60 that is possessed by each ejecting section 600 which is provided in a manner that corresponds to the third nozzle column 650*c* and the fourth nozzle column 650*d*. Furthermore, the drive signal VOUT that is output by the drive signal selection circuits 120-3 is applied to one terminal of the piezoelectric element 60 that is possessed by each ejecting section 600 which is provided in a manner that corresponds to the fifth nozzle column 650*e* and the sixth nozzle columns 650*f*. Furthermore, the drive signal VOUT that is output by the drive signal selection circuits 120-4 is applied to one terminal of the piezoelectric element 60 that is possessed by each ejecting section 600 which is provided in a manner that corresponds to the seventh nozzle column 650*g* and the eighth nozzle columns 650*h*. Furthermore, the drive signal VOUT that is output by the drive signal selection circuits 120-5 is applied to one terminal of the piezoelectric element 60 that is possessed by each ejecting section 600 which is provided in a manner that corresponds to the ninth nozzle column 650*i* and the tenth nozzle columns 650*j*. Furthermore, the drive signal VOUT that is output by the drive signal selection circuits 120-6 is applied to one terminal of the piezoelectric element 60 that is possessed by each ejecting section 600 which is provided in a manner that corresponds to the eleventh nozzle column 650*k* and the twelfth nozzle columns 650*l*.

An offset voltage VBS that is transferred over the cable 201 is supplied to the other terminal of the piezoelectric element 60 that is possessed by each of all the ejecting sections 600.

Each piezoelectric element 60 is provided in a manner that corresponds to each of the ejecting sections 600, and is displaced by application of the drive signal VOUT (the drive signal COMA or COMB). Then, each piezoelectric element 60 is displaced according to a difference in electric potential between the drive signal VOUT (the drive signal COMA or COMB) and the offset voltage VBS, and thus causes liquid (ink) to be ejected. In this manner, the drive signal COMA or COMB is a signal for driving each of the ejecting sections 600 and thus ejecting liquid, and the head unit 20 (the head 21) ejects the liquid (the ink) according to the drive signal COMA or COMB.

3. CONFIGURATION OF THE EJECTING SECTION

Figure 5:
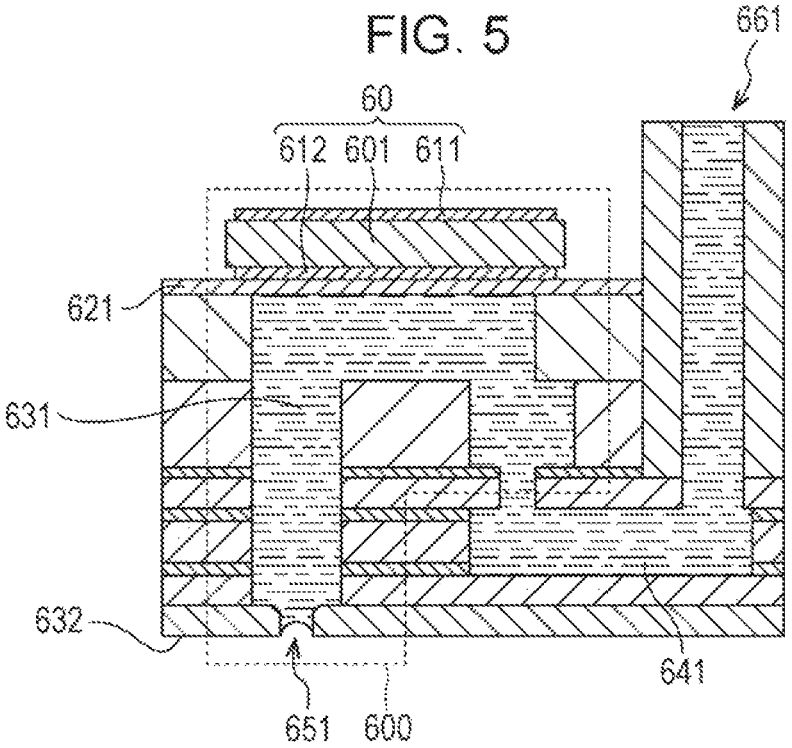
FIG. 5 is a diagram illustrating a schematic configuration that corresponds to one ejecting section.

FIG. 5 is a diagram illustrating a schematic configuration that corresponds to one ejecting section 600 that is possessed by the head 21. As illustrated in FIG. 5, the head 21 includes the ejecting section 600 and a reservoir 641.

The reservoir 641 is provided for every color of ink, and ink is introduced from the supply outlet 661 into the reservoir 641. It is noted that ink is supplied from the ink storage section 8 through the ink tube 9 to the supply outlet 661.

The ejecting section 600 includes the piezoelectric element 60, a vibration plate 621, a cavity (a pressure chamber) 631, and the nozzle 651. Among these, the vibration plate 621 is displaced (bending-vibrated) by the piezoelectric element 60 that is provided on an upper surface in FIG. 5, and functions as a diaphragm that increases or decreases an internal volume of the cavity 631 that is filled with ink. The nozzle 651 is an orifice that is provided in the nozzle plate 632 and communicates with the cavity 631. The cavity 631 is filled with liquid (for example, ink), and an internal volume thereof changes with the displacement of the piezoelectric element 60. The nozzle 651 communicates with the cavity 631, and through the nozzle 651, liquid within the cavity 631 is ejected as a droplet of liquid according to a change in the internal volume of the cavity 631.

The piezoelectric element 60, which is illustrated in FIG. 5, has a structure in which a piezoelectric body 601 is interposed between a pair of electrodes 611 and 612. The center portion of the piezoelectric body 601 in this structure warps in the upward-downward direction with respect to both terminal portions in FIG. 5, along with the electrodes 611 and 612 and the vibration plate 621, according to a pressure that is applied by the electrodes 611 and 612. Specifically, the drive signal VOUT is applied to the electrode 611 that is one terminal of the piezoelectric element 60, and the offset voltage VBS is applied to the electrode 612 that is the other terminal of the piezoelectric element 60. Then, the piezoelectric element 60 is configured in such a manner that when a voltage of the drive signal VOUT decreases, the piezoelectric element 60 warps in the upward direction, and that when the voltage of the drive signal VOUT increases, the piezoelectric element 60 warps in the downward direction. With this configuration, if the warping occurs in the upward direction, the internal volume of the cavity 631 increases, ink flows from the reservoir 641 into the cavity 631, and on the other hand, if the warping occurs in the downward direction, the internal volume of the cavity 631 decreases, ink is ejected through the nozzle 651 according to the degree to which the internal volume decreases.

It is noted that the piezoelectric element 60 is not limited to the structure that is illustrated, and that any structure in which transformation of the piezoelectric element 60 causes liquid, such as ink, to be ejected may be employed. Furthermore, the piezoelectric element 60 is not limited to the bending vibration, and a configuration in which so-called longitudinal vibration is used may be employed.

Furthermore, the piezoelectric element 60 is provided in a manner that corresponds to the cavity 631 and the nozzle 651 in the head 21, and is provided in a manner that also corresponds to a selection section 230 (refer to FIG. 8) that will be described below. For this reason, a set of the piezoelectric element 60, the cavity 631, the nozzle 651, and the selection section 230 is provided for every nozzle 651.

4. CONFIGURATION OF THE DRIVE SIGNAL

In addition to a method of ejecting an ink droplet one time and thus forming one dot, methods of forming a dot onto the printing medium P include a method (a second method) in which, with ink droplet being set to be possibly ejected two or more times during a unit duration, one or more ink droplets that are ejected during the unit duration are landed, the one or more ink landed droplets are combined, and thus one dot is formed, and a method (a third method) in which two or more dots are formed without combining the two or more ink droplets.

In the present embodiment, with the second method, for one dot, ink is ejected a maximum number of times, two times, and thus four gray scales, a "large-sized dot", a "middle-sized dot", a "small-sized dot", and "non-recording (no dot)" are expressed. In order to express the four gray scales, in the present embodiment, two types of drive signals, drive signals COMA and COMB are prepared, and each of the drive signals is caused to have a first-half pattern and a second-half pattern at one periodicity. A configuration is employed in which the drive signal COMA or COMB at the first half and second half of one periodicity is selected (or is not selected) according to a gray scale that has to be expressed, and is supplied to the piezoelectric element 60.

Figure 6:
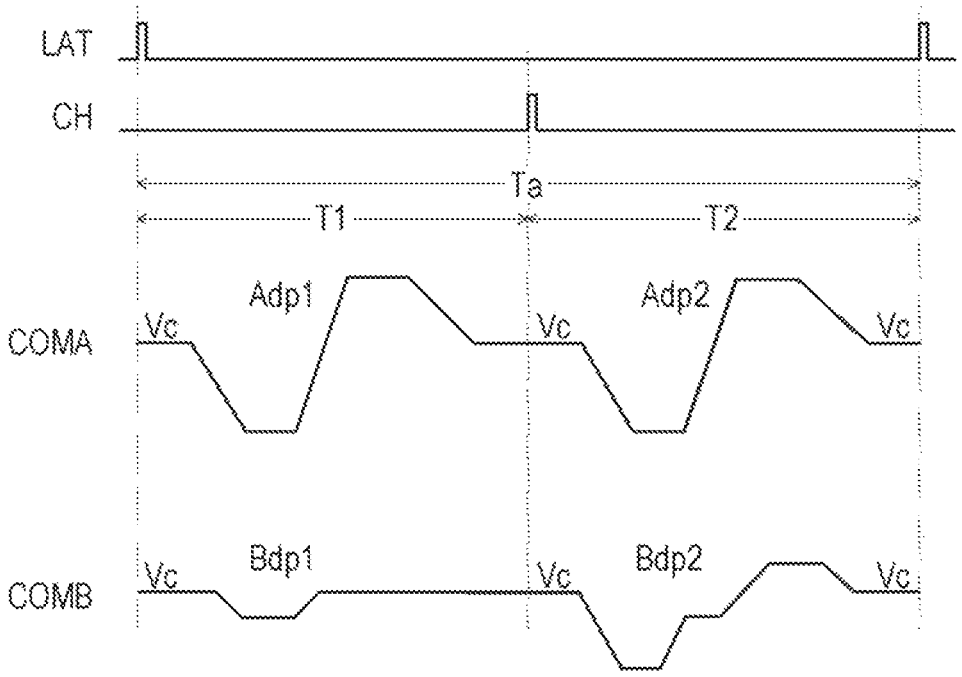
FIG. 6 is a diagram illustrating a waveform drive signals.

FIG. 6 is a diagram illustrating a waveform of each of the drive signal COMA and COMB. As illustrated in FIG. 6, the drive signal COMA has a waveform that results from successively combining a trapezoid waveform Adp1 that is generated during a duration T1 from when the latch signal LAT is on the rising edge to when the change signal CH is on the rising edge, and a trapezoid waveform Adp2 that is generated during a duration T2 from when the change signal CH is on the rising edge and to when next, the latch signal LAT is on the rising edge. A periodicity that is made up of the durations T1 and T2 is defined as a periodicity Ta. A new dot is formed on the printing medium P at every periodicity Ta.

In the present embodiment, the trapezoid waveforms Adp1 and Adp2 are the same waveform. Each of the trapezoid waveforms Adp1 and Adp2 is a waveform which, if set to be supplied to one terminal of the piezoelectric element 60, causes a given amount of ink, specifically, a middle-sized amount of ink to be ejected through the nozzle 651 that corresponds to the piezoelectric element 60.

The drive signal COMB has a waveform that results from successively combining a trapezoid waveform Bdp1 that is generated during the duration T1 and a trapezoid waveform Bdp2 that is generated during the duration T2. In the present embodiment, the trapezoid waveforms Bdp1 and Bdp2 are waveforms that are different from each other. Among these, the trapezoid waveforms Bdp1 is a waveform for minutely vibrating ink in the vicinity of the orifice in the nozzle 651 and thus preventing an increase in viscosity of the ink. For this reason, even if the trapezoid waveform Bdp1 is supplied to one terminal of the piezoelectric element 60, an ink droplet is not ejected through the nozzle 651 that corresponds to the piezoelectric element 60. Furthermore, the trapezoid waveforms Bdp2 is a waveform that is different from the trapezoid waveforms Adp1 (Adp2). The trapezoid waveform Bdp2 is a waveform that, if set to be supplied to one terminal of the piezoelectric element 60, causes an amount of ink, which is smaller than the given amount of ink, to be ejected through the nozzle 651 that corresponds to the piezoelectric element 60.

It is noted that any one of a voltage at a starting time for the trapezoid waveforms Adp1, Adp2, Bdp1, and Bdp2 and a voltage at an ending time, and a voltage Vc are common. That is, the trapezoid waveforms Adp1, Adp2, Bdp1, and Bdp2 are waveforms that start at the voltage Vc and ends at the voltage Vc.

Figure 7:
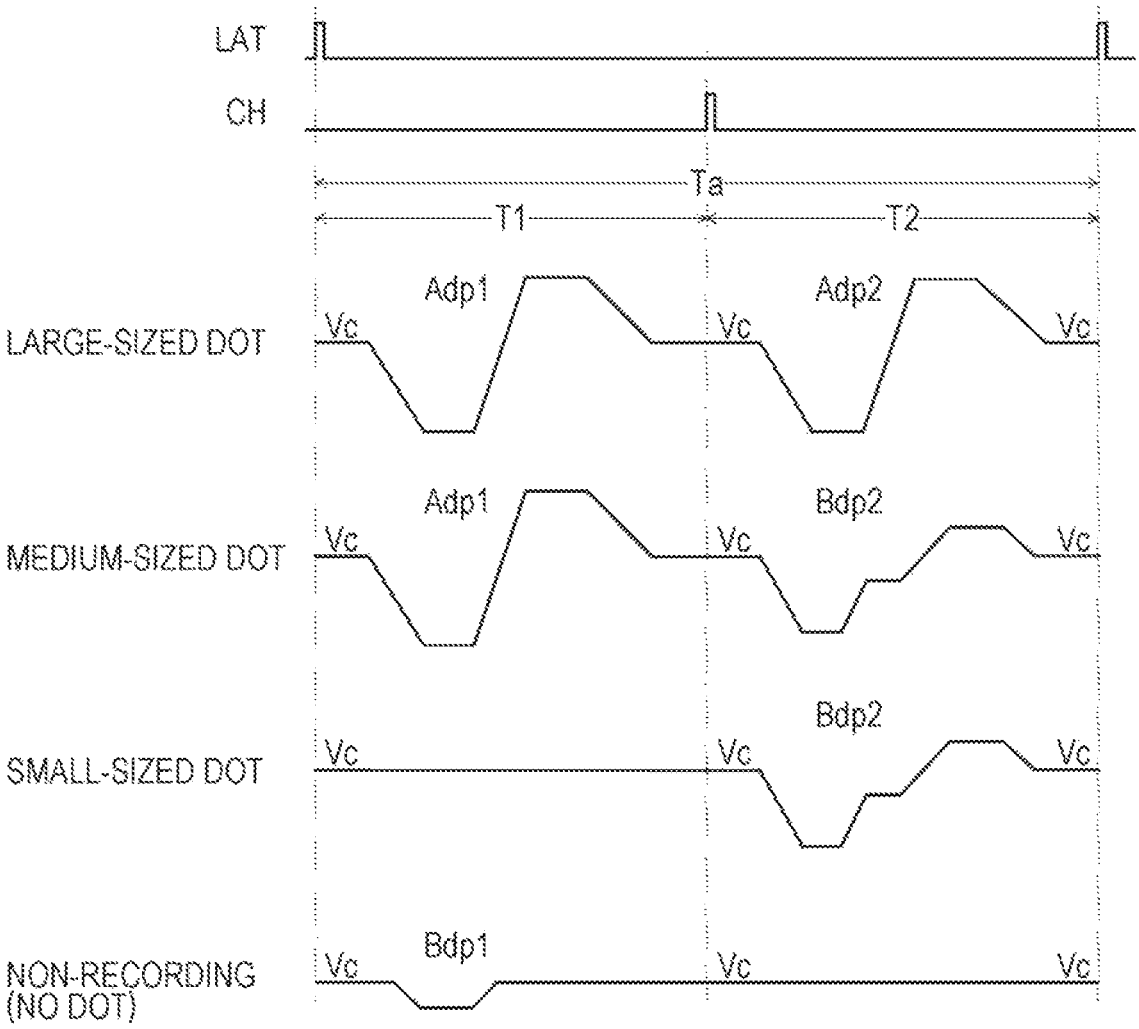
FIG. 7 is a diagram illustrating a waveform of a drive signal.

FIG. 7 is a diagram illustrating a waveform of the drive signal VOUT that corresponds to each of the "large-sized dot", "middle-sized dot", "small-sized dot", and "no recording".

As illustrated in FIG. 7, the drive signal VOUT that corresponds to the "large-sized dot" has a waveform that results from successively combining the trapezoid waveform Adp1 of the drive signal COMA during the duration T1, and the trapezoid waveform Adp2 of the drive signal COMA during the duration T2. When the drive signal VOUT is supplied to one terminal of the piezoelectric element 60, at the periodicity Ta, the middle-sized amount of ink is ejected over two times through the nozzle 651 that corresponds to the piezoelectric element 60. For this reason, the amounts of ink are landed onto the printing medium P and are combined, thereby forming a large-sized dot.

The drive signal VOUT that corresponds to the "middle-sized dot" has a waveform that results from successively combining the trapezoid waveform Adp1 of the drive signal COMA during the duration T1, and the trapezoid waveform Bdp2 of the drive signal COMB during the duration T2. When the drive signal VOUT is supplied to one terminal of the piezoelectric element 60, at the periodicity Ta, the middle-sized amount of ink and the small-sized amount of ink are ejected over two times, one time for each, through the nozzle 651 that corresponds to the piezoelectric element 60. For this reason, the amounts of ink are landed onto the printing medium P and are combined, thereby forming a middle-sized dot.

The drive signal VOUT that corresponds to the "small-sized dot is at the immediately-preceding voltage Vc that is retained due to the capacitance of the piezoelectric element 60, during the duration T1, and has the trapezoid waveform Bdp2 of the drive signal COMB during the duration T2. When the drive signal VOUT is supplied to one terminal of the piezoelectric element 60, at the periodicity Ta, the small-sized amount of ink is ejected through the nozzle 651 that corresponds to the piezoelectric element 60, only during the duration T2. For this reason, the amount of ink is landed onto the printing medium P and thus forms a small-sized dot.

The drive signal VOUT that corresponds to the "non-recording" has the trapezoid waveform Bdp1 of the drive signal COMB during the duration T1, and is at the immediately-preceding voltage Vc that is retained due to the capacitance of the piezoelectric element 60, during the duration T2. When the drive signal VOUT is supplied to one terminal of the piezoelectric element 60, at the periodicity Ta, the nozzle 651 that corresponds to the piezoelectric element 60 minutely vibrates during the duration T2. Because of this, ink is not ejected. For this reason, ink is not landed onto the printing medium P, and a dot is not formed.

5. CONFIGURATION OF THE DRIVE SIGNAL SELECTION CIRCUIT

Figure 8:
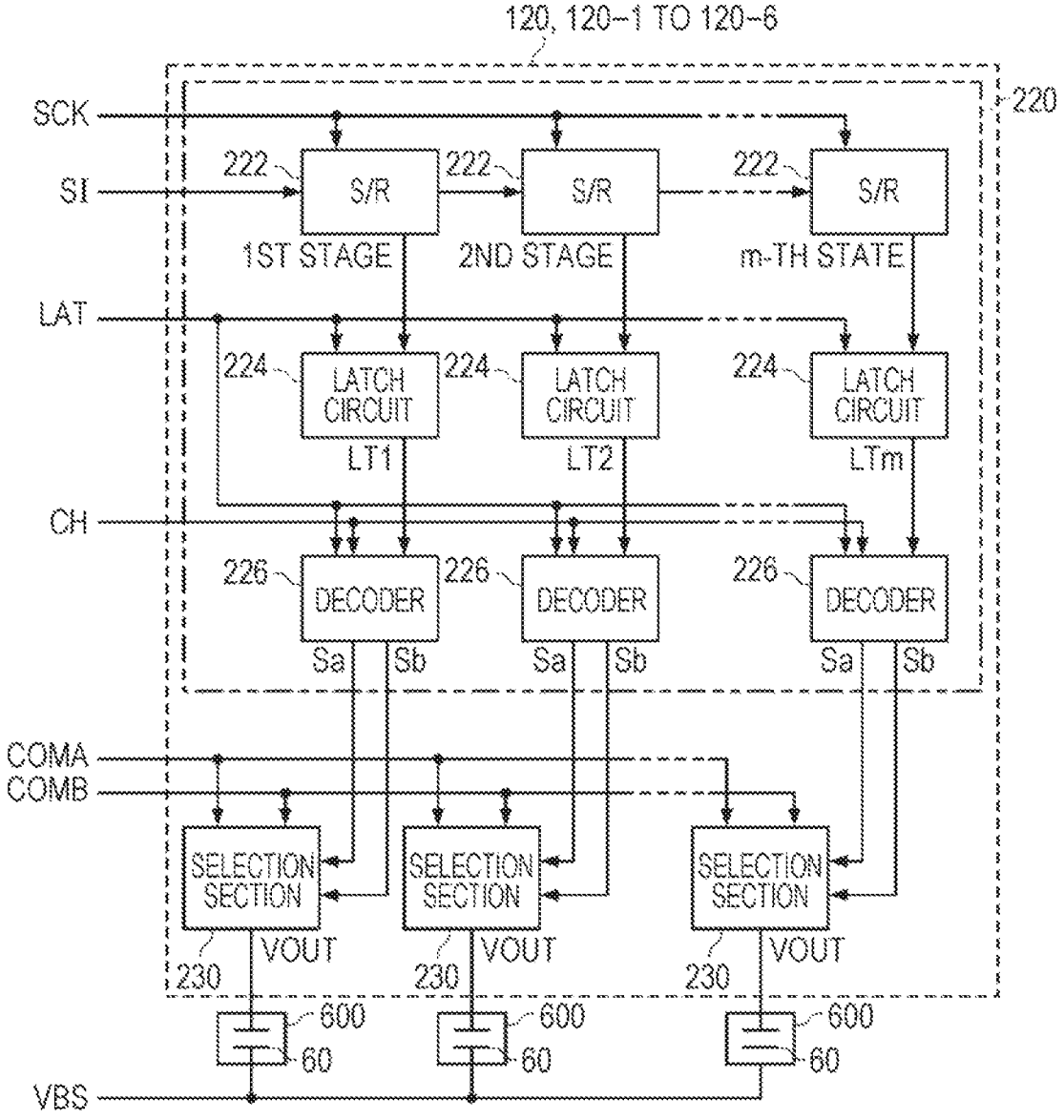
FIG. 8 is a diagram illustrating a configuration of a drive signal selection circuit.

FIG. 8 is a diagram illustrating a configuration of a drive signal selection circuit 120 (120-1 to 120-6). As illustrated in FIG. 8, the drive signal selection circuit 120 includes a selection control section 220 and a plurality of selection sections 230.

Supplied to the selection control section 220 are the clock signal SCK, the printing data signal SI (SI1 to SI6), the latch signal LAT, and the change signal CH. In the selection control section 220, a set of a shift register (S/R) 222, a latch circuit 224, and a decoder 226 is provided in a manner that corresponds to each of the piezoelectric elements 60 (the nozzles 651). That is, the number of the sets of the shift register (S/R) 222, and the latch circuit 224, and the decoder 226, which are possessed by one drive signal selection circuit 120, is the same as the total number m of the nozzles 651 that are included in two nozzle columns 650.

The printing data signal SI is a signal, the total number of whose bits is 2 m, and that includes two-bit printing data (SIH, SIL) for selecting any one of the "large-sized bit", the "middle-sized bit", the "small-sized bit", and the "non-recording" for each of m ejecting sections 600 (the piezoelectric elements 60).

The printing data signal SI is a signal that is synchronized to the clock signal SCK, and the shift register 222 is configured to temporarily retain every two-bit printing data (SIH, SIL) that is included in the printing data signal SI, which corresponds to the nozzle 651.

For detail, a configuration is employed in which stage-wise shift registers 222 that correspond to the piezoelectric elements 60 (the nozzles 651) are connected in a cascade to each other and in which the printing data signals SI that are serially supplied are sequentially transferred in the downstream direction according to the clock signal SCK.

It is noted that, in order to distinguish among the shift registers 222, the shift registers 222 are expressed as the first-stage shift register 222, the second-stage shift register 222, and so forth up to the m-th-stage shift register 222, starting from the most upstream side toward which the printing data signal SI is supplied.

Each of the m latch circuits 224 latches the two-bit printing data (SIH, SIL) that is retained in each of the m shift registers 222 with the rising edge of the latch signal LAT.

Each of the m decoders 226 decodes the two-bit printing data (SIH, SIL) that is latched by each of the m latch circuits 224, outputs the selection signals Sa and Sb during each of the durations T1 and T2 that are stipulated with the latch signal LAT and the change signal CH, and thus stipulates the selection in the selection section 230.

Figures 9, 10:
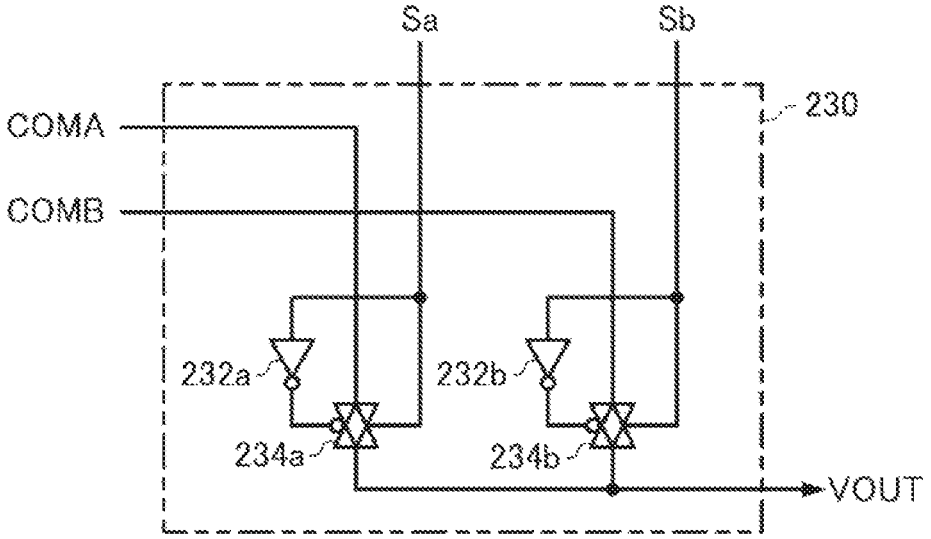
FIG. 9 is a diagram illustrating decoding details in a decoder.
FIG. 10 is a diagram illustrating a configuration of a selection section.

FIG. 9 is a diagram illustrating decoding details in the decoder 226. It is meant that, for example, if the latched two-bit printing data (SIH, SIL) is (1, 0), the decoder 226 set logical levels of the selection signals Sa and Sb to be a high level and a low level, respectively, during the duration T1, and sets the logical levels to be the low and high levels, respectively, during the duration T2, and outputs the result.

It is noted that the selection signals Sa and Sb is level-shifted by a level shifter (whose illustration is omitted) to high-amplitude logic rather than logical levels of the clock signal SCK, the printing data signal SI, the latch signal LAT, and the change signal CH.

The selection section 230 is provided in a manner that corresponds to each of the piezoelectric elements 60 (the nozzles 651). That is, the number of the selection sections 230 that are possessed by one drive signal selection circuit 120 is the same as the total number m of the nozzles 651 that are included in two nozzle columns 650.

FIG. 10 is a diagram illustrating a configuration of the selection section 230 that corresponds to one piezoelectric element 60 (one nozzle 651).

As illustrated in FIG. 10, the selection section 230 has inverters (NOT circuits) 232*a* and 232*b*, and transistor gates 234*a* and 234*b*.

A selection signal Sa from the decoder 226 is supplied to a positive control terminal of the transistor gate 234*a*, which is not marked with a circle. On the other hand, the selection signal Sa is logic-inverted by the inverter 232*a* and is supplied to a negative control terminal of the transistor gate 234*a*, which is marked with a circle. In the same manner, a selection signal Sb is a positive control terminal of the transistor gate 234*b*. On the other hand, the selection signal Sb is logic-inverted by the inverter 232*b* and is supplied to a negative control terminal of the transistor gate 234*b*.

The drive signal COMA is supplied to an input terminal of the transistor gate 234*a*, and the drive signal COMB is supplied to an input terminal of transistor gate 234*b*. Output terminals of the transistor gates 234*a* and 234*b* are connected in a shared manner, and the drive signal VOUT is output to the ejecting section 600 through the common connection terminal.

If the selection signal Sa is at the high level, a conductive connection is made (is set to be on) between the input terminal and the output terminal of the transistor gates 234*a*. If the selection signal Sa is at the low level, a conductive connection is not made (is set to be off) between the input terminal and the output terminal. In the same manner, according to the selection signal Sb, a conductive connection is set to be on or is set to be off between the input terminal and output terminal of the transistor gate 234*b*.

Next, operation of the drive signal selection circuit 120 (120-1 to 120-6) will be described with reference to FIG. 11.

The printing data signals SI (SI1 to SI6) are synchronized to the clock signal SCK, are serially supplied, and are sequentially transferred in the shift register 222 that corresponds to the nozzle. Then, when the supply of the clock signal SCK is stopped, a state is attained where the two-bit printing data (SIH, SIL) that corresponds to the nozzle 651 is retained in each of the shift registers 222. It is noted that the printing data signals SI are sequentially supplied in a manner that corresponds to the final m-th-stage and so forth up to the second-stage nozzle and the first-stage nozzle in the shift register 222.

At this point, when the latch signal LAT is on the rising edge, each of the latch circuits 224 simultaneously latches the two-bit printing data (SIH, SIL) that is retained in the shift register 222. In FIG. 11, LT1, LT2, and so forth up to LTm illustrate the two-bit printing data (SIH, SIL) that is latched by the latch circuit 224 which corresponds to the first-stage shift register 222, the second-stage shift register 222, and so forth up to the m-th-shift register 222.

The decoder 226 outputs logical levels of the selection signals Sa and Sb, using the content that is illustrated in FIG. 9, according to a size of a dot that is stipulated with the latched two-bit printing data (SIH, SIL) during each of the durations T1 and T2.

That is, in a case where the printing data (SIH, SIL) is (1, 1) and where a size of the large-sized dot is stipulated, the decoder 226 sets the selection signals Sa and Sb to be at the high and low levels, respectively, during the duration T1, and also sets the selection signals Sa and Sb to be at the high and low levels, respectively, during the duration T2. Furthermore, in a case where the printing data (SIH, SIL) is (1, 0) and where a size of the middle-sized dot is stipulated, the decoder 226 sets the selection signals Sa and Sb to be at the high and low levels, respectively, during the duration T1, and sets the selection signals Sa and Sb to be at the low and high levels, respectively, during the duration T2. Furthermore, in a case where the printing data (SIH, SIL) is (0, 1) and where a size of the small-sized dot is stipulated, the decoder 226 sets the selection signals Sa and Sb to be at the low and low levels, respectively, during the duration T1, and sets the selection signals Sa and Sb to be at the low and high levels, respectively, during the duration T2. Furthermore, in a case where the printing data (SIH, SIL) is (0, 0) and where the non-recording is stipulated, the decoder 226 sets the selection signals Sa and Sb to be a low level and a high level, respectively, during the duration T1, and sets the selection signals Sa and Sb to be a low level and a low level, respectively, during the duration T2.

When the printing data (SIH, SIL) is (1, 1), during the duration T1, the selection signals Sa and Sb are at the high and low levels, respectively, and because of this, the selection section 230 selects the drive signal COMA (the trapezoid waveforms Adp1). Furthermore, during the duration T2, the selection signals Sa and Sb are also at the high and low levels, respectively, and because of this, the selection section 230 selects the drive signal COMA (the trapezoid waveform Adp2). As a result, the drive signal VOUT that corresponds to the "large-sized dot" that is illustrated in FIG. 7 is generated.

Further, the printing data (SIH, SIL) is (1, 0), during the duration T1, the selection signals Sa and Sb are at the high and low levels, respectively, and because of this, the selection section 230 selects the drive signal COMA (the trapezoid waveforms Adp1). Furthermore, during the duration T2, the selection signals Sa and Sb are at the low and high levels, respectively, and because of this, the selection section 230 selects the drive signal COMB (the trapezoid waveform Bdp2). As a result, the drive signal VOUT that corresponds to the "middle-sized dot" that is illustrated in FIG. 7 is generated.

Further, the printing data (SIH, SIL) is (0, 1), during the duration T1, the selection signals Sa and Sb are at the low and low levels, respectively, and because of this, the selection section 230 selects neither the drive signal COMA, nor the drive signal COMB. Furthermore, during the duration T2, the selection signals Sa and Sb are at the low and high levels, respectively, and because of this, the selection section 230 selects the drive signal COMB (the trapezoid waveform Bdp2). As a result, the drive signal VOUT that corresponds to the "small-sized dot" that is illustrated in FIG. 7 is generated. It is noted that, because none of the drive signals COMA and COMB is selected during the duration T1, one terminal of the piezoelectric element 60 is opened, but the drive signal VOUT is retained in the immediately preceding voltage Vc due to the capacitance of the piezoelectric element 60.

Further, the printing data (SIH, SIL) is (0, 0), during the duration T1, the selection signals Sa and Sb are at the low and high levels, respectively, and because of this, the selection section 230 selects the drive signal COMB (the trapezoid waveforms Bdp1). Furthermore, during the duration T2, the selection signals Sa and Sb are at the low and low levels, respectively, and because of this, the selection section 230 selects neither the drive signal COMA, nor the drive signal COMB. As a result, the drive signal VOUT that corresponds to the "Non-recording" that is illustrated in FIG. 7 is generated. It is noted that, because none of the drive signals COMA and COMB is selected during the duration T2, one terminal of the piezoelectric element 60 is opened, but the drive signal VOUT is retained in the immediately preceding voltage Vc due to the capacitance of the piezoelectric element 60.

Figure 11:
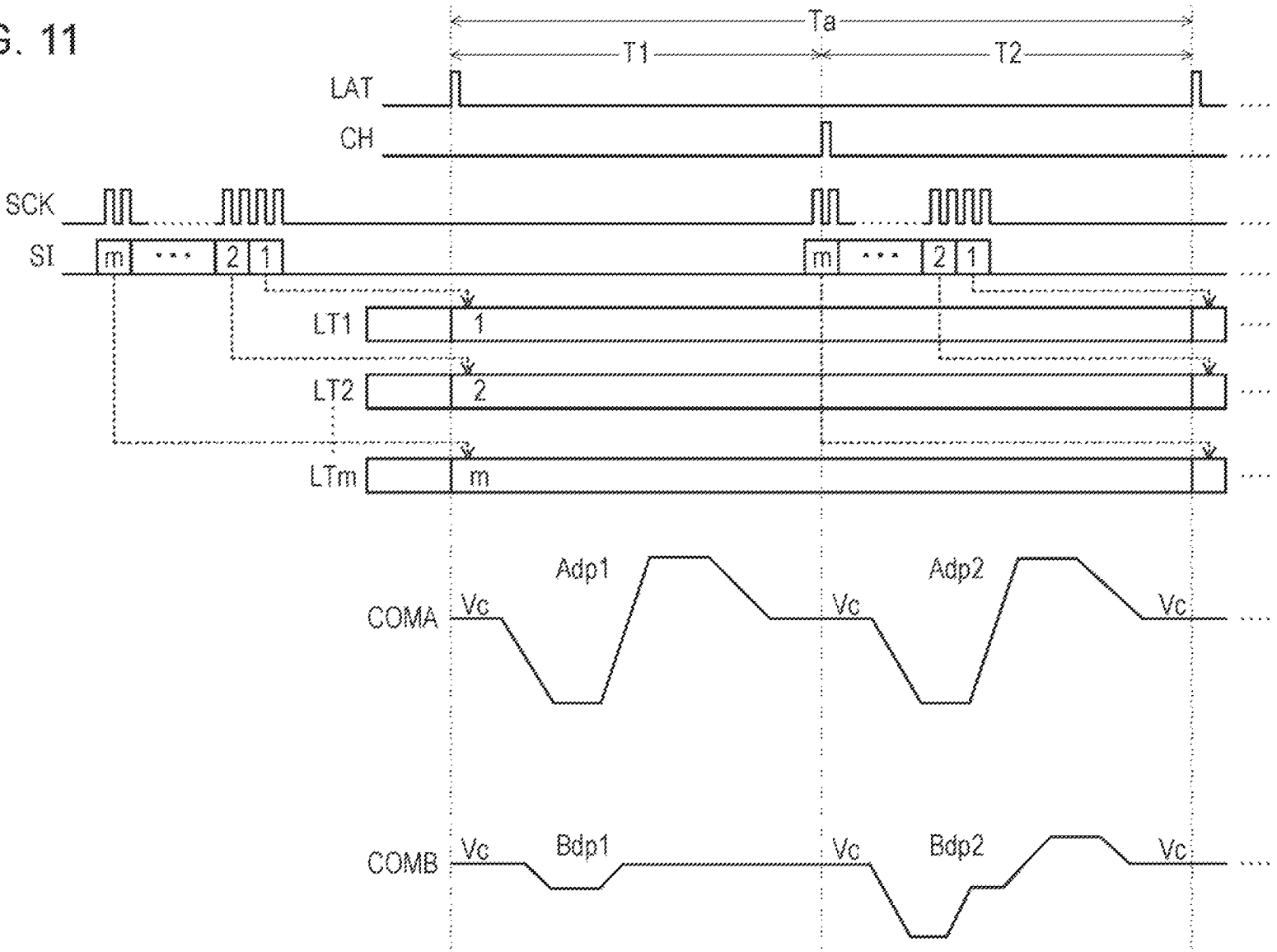
FIG. 11 is a diagram for describing operation of the drive signal selection circuit.

It is noted that each of the drive signals COMA and COMB, which is illustrated in FIGS. 6 and 11, is only one example. In practice, a combination of various waveforms that are prepared in advance is used according to a moving speed of the head unit 20, a property of a printing medium P, or the like.

Furthermore, at this point, the example where the piezoelectric element 60 warps in the upward direction due to the decrease in voltage is described here, but when the voltage that is supplied to the electrodes 611 and 612 is reversed, the piezoelectric element 60 warps in the downward direction due to the decrease in voltage. For this reason, in the configuration in which the piezoelectric element 60 warps in the downward direction due to the decrease in voltage, the drive signals COMA and COMB that are illustrated in FIGS. 6 and 11 have inversed waveforms in terms of the voltage Vc.

6. CONFIGURATION OF THE DRIVE CIRCUIT

Figure 12:
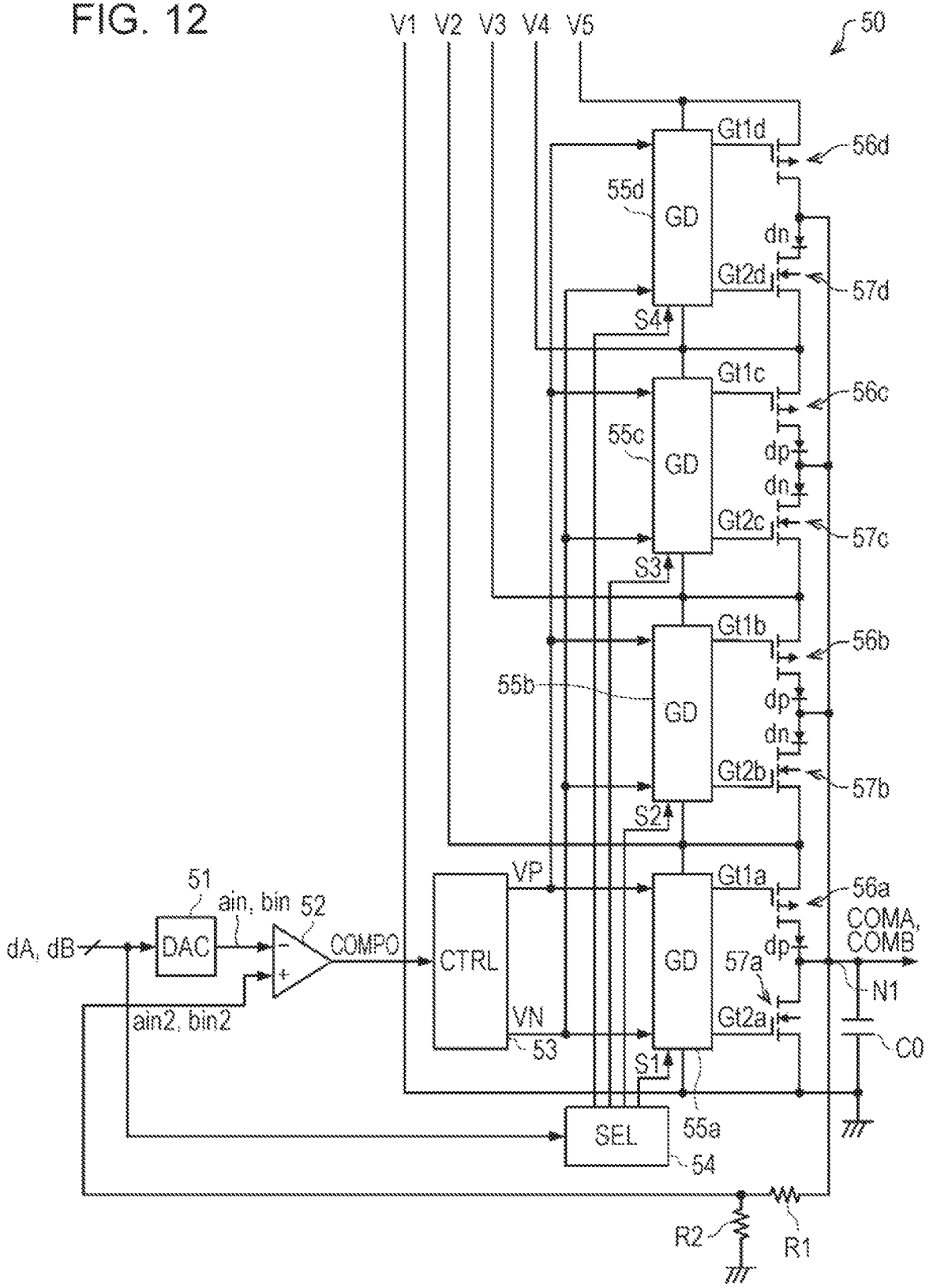
FIG. 12 is a diagram illustrating a configuration of a drive circuit.

Next, a configuration of each of the drive circuits 50*a* and 50*b*, which are assumed to have the same configuration, will be described in detail. FIG. 12 is a diagram illustrating a configuration of a drive circuit 50 (50*a* and 50*b*). As illustrated in FIG. 12, the drive circuit includes a D/A conversion circuit (digital-to-analog converter (DAC)) 51, a comparator 52, a gate driver control circuit 53, a selector 54, gate drivers 55*a*, 55*b*, 55*c*, and 55*d*, transistors 56*a*, 57*a*, 56*b*, 57*b*, 56*c*, 57*c*, 56*d*, and 57*d*, and a capacitor C0, and resistance elements R1 and R2. The low power source voltage VDD and the ground voltage GND are supplied to the D/A conversion circuit 51, the comparator 52, the gate driver control circuit 53, and the selector 54, illustration of which are illustrated.

As described above, five types of power source voltages, power source voltages V1 to V5 are supplied to the drive circuit 50. It is hereinafter assumed that the power source voltage V1 is 0 V, the power source voltage V2 is 10.5 V, the power source voltage V3 is 21 V, the power source voltage V4 is 31.5 V, and the power source voltage V5 is 42 V.

In the present embodiment, a range where a voltage is equal to or higher than the power source voltage V1 (0 V) and is lower than the power source voltage V2 (10.5 V) is defined as a first range, a range where a voltage is equal to or higher than the power source voltage V2 (10.5 V) and is lower than the power source voltage V3 (21 V) is defined as a second range, a range where a voltage is equal to or higher than the power source voltage V3 (21 V) and is lower than the power source voltage V4 (31.5 V) is defined as a third range, and a range where a voltage is equal to or higher than the power source voltage V4 (31.5 V) and is lower than the power source voltage V5 (42 V) is defined as a fourth range.

The D/A conversion circuit 51 converts the drive dA (dB), which is a digital signal that stipulates a waveform of the drive signal COMA (COMB), into a source drive signal ain (bin) that is an analog signal which is a source of the drive signal COMA (COMB).

The source drive signal ain (bin) is supplied to a minus input terminal (−) of the comparator 52, a feedback signal ain2 (bin2) is supplied to a positive input terminal (+) of the comparator 52. The comparator 52 compares a voltage of the source drive signal ain (bin) and a voltage of the feedback signal ain2 (bin2). The feedback signal ain2 (bin2) is a signal that results from feeding back the drive signal COMA (COMB), for more detail, a signal that results from pressure-dividing the drive signal COMA (COMB) according to a resistance ratio between the resistance element R1 and the resistance element R2. The comparator 52 outputs a signal COMPO that is at a high level when the voltage of the feedback signal ain2 (bin2) is higher than the voltage of the source drive signal ain (bin) and that is at a low level at any other time.

Based on an output signal COMPO of the comparator 52, the gate driver control circuit 53 outputs control signals VP and VN that control the gate drivers 55*a* to 55*d*. Specifically, if the output signal COMPO of the comparator 52 is at the low level, the gate driver control circuit 53 outputs the control signals VP and VN that are both at the low level. On the other end, if the output signal COMPO of the comparator 52 is at the high level, the gate driver control circuit 53 outputs the control signal VP and VN that are both at the high level.

The selector 54 causes the gate driver 55*a* to possibly operate when a voltage of the drive signal COMA (COMB) is between the power source voltage V1 and the power source voltage V2 (in the first range), causes the gate driver 55*b* to possibly operate when the voltage of the drive signal COMA (COMB) is between the power source voltage V2 and the power source voltage V3 (in the second range), causes the gate driver 55*c* to possibly operate when the voltage of the drive signal COMA (COMB) is between the power source voltage V3 and the power source voltage V4 (in the third range), and causes the gate driver 55*d* to possibly operate when the voltage of the drive signal COMA (COMB) is between the power source voltage V4 and the power source voltage V5 (in the fourth range). Specifically, based on the drive data dA (dB) that is supplied from the control section 111 (refer to FIG. 4), the selector 54 determines within which one of the first to fourth ranges the voltage of the drive signal COMA (COMB) falls, and based on a result of the determination, outputs selection signals S1 to S4 for selecting and operating any one of the gate drivers 55*a* to 55*d*.

For more detail, in a case where it is determined that the voltage of the drive signal COMA (COMB) falls within the first range (where the voltage is equal to or higher than the power source voltage V1 (0 V) and lower than the power source voltage V2 (10.5 V)), the selector 54 sets only the selection signal S1 to be at a high level, and sets the selection signals S2, S3, and S4 to be at a low level. Furthermore, in a case where it is determined that the voltage of the drive signal COMA (COMB) falls within the second range (where the voltage is equal to or higher than the power source voltage V2 (10.5 V) and lower than the power source voltage V3 (21 V)), the selector 54 sets only the selection signal S2 to be at the high level, and sets the selection signals S1, S3, and S4 to be at the low level. Furthermore, in a case where it is determined that the voltage of the drive signal COMA (COMB) falls within the third range (where the voltage is equal to or higher than the power source voltage V3 (21 V) and lower than the power source voltage V4 (31.5 V)), the selector 54 sets only the selection signal S3 to be at the high level, and sets the selection signals S1, S2, and S4 to be at the low level. Furthermore, in a case where it is determined that the voltage of the drive signal COMA (COMB) falls within the fourth range (where the voltage is equal to or higher than the power source voltage V4 (31.5 V) and lower than the power source voltage V5 (42 V)), the selector 54 sets only the selection signal S4 to be at the high level, and sets the selection signals S1, S2, and S3 to be at the low level.

It is noted that, based on a voltage of the signal (for example, the feedback signal ain2 (bin2) that results from feeding back the drive signal COMA (COMB), the selector 54 may determine within which one of the first to fourth ranges the voltage of the drive signal COMA (COMB) falls, and, based on a result of the determination, may output the selection signals S1 to S4. Alternatively, based on both the drive data dA (dB) and the signal that results from feeding back the drive signal COMA (COMB), the selector 54 may determine within which one of the first to fourth range the voltage of the drive signal COMA (COMB) falls, and, based on a result of the determination, may output the selection signals S1 to S4.

As described above, the D/A conversion circuit 51, the comparator 52, the gate driver control circuit 53, and the selector 54 function as control circuits that generate the control signals VP and VN and the selection signals S1 to S4, based on the drive data dA (dB) and the feedback signal ain2 (bin2), and that control operation of each of the gate drivers 55*a* to 55*d*.

The gate driver 55*a* operates by being supplied with the power source voltage V1 in a low voltage range and the power source voltage V2 in a high voltage range, and generates control signals Gt1*a* and Gt2*a* that control switching operation of a transistor pair (hereinafter referred to as a "transistor pair that is made up of the transistors 56*a* and 57*a*") that includes the transistors 56*a* and 57*a*. Specifically, when the selection signal S1 is at the high level, the gate driver 55*a* increases the power source voltage V1 of each of the control signal VP and the control signal VN up to the range (the first range) of the power source voltages V2, and supplies the resulting control VP and control signal VN, as the control signal Gt1*a* and the control signal Gt2*a*, to a gate terminal of the transistor 56*a* and a gate terminal of the transistor 57*a*, respectively. However, in a case where a range from the lowest voltage of the control signals VP and VN to the highest voltage is consistent with the first range, an amount of level shift in the control signals VP and VN may be 0 V (may not be level-shifted). Furthermore, when the section signal S1 is at the low level, the gate driver 55*a* supplies the control signal Gt1*a* at a high-level voltage (a voltage in the vicinity of the power source voltage V2) to the gate terminal of the transistor 56*a*, supplies the control signal Gt2*a* at a low-level voltage (a voltage in the vicinity of the power source voltage V1) to the gate terminal of the transistor 57*a*, and sets both the transistors 56*a* and 57*a* to be off.

In the same manner, the gate driver 55*b* operates by being supplied with the power source voltage V2 in a low voltage range and the power source voltage V3 in a high voltage range, and generates control signals Gt1*b* and Gt2*b* that control switching operation of a transistor pair (hereinafter referred to as a "transistor pair that is made up of the transistors 56*b* and 57*b*") that includes the transistors 56*b* and 57*b*. Specifically, when the selection signal S2 is at the high level, the gate driver 55*b* increases the power source voltage V2 of each of the control signal VP and the control signal VN up to the range (the second range) of the power source voltages V3, and supplies the resulting control VP and control signal VN, as the control signal Gt1*b* and the control signal Gt2*b*, to a gate terminal of the transistor 56*b* and a gate terminal of the transistor 57*b*, respectively. Furthermore, when the section signal S2 is at the low level, the gate driver 55*b* supplies the control signal Gt1*b* at a high-level voltage (a voltage in the vicinity of the power source voltage V3) to the gate terminal of the transistor 56*b*, supplies the control signal Gt2*b* at a low-level voltage (a voltage in the vicinity of the power source voltage V2) to the gate terminal of the transistor 57*b*, and sets both the transistors 56*b* and 57*b* to be off.

In the same manner, the gate driver 55*c* operates by being supplied with the power source voltage V3 in a low voltage range and the power source voltage V4 in a high voltage range, and generates control signals Gt1*c* and Gt2*c* that control switching operation of a transistor pair (hereinafter referred to as a "transistor pair that is made up of the transistors 56*c* and 57*c*") that includes the transistors 56*c* and 57*c*. Specifically, when the selection signal S3 is at the high level, the gate driver 55*c* increases the power source voltage V3 of each of the control signal VP and the control signal VN up to the range (the third range) of the power source voltages V4, and supplies the resulting control VP and control signal VN, as the control signal Gt1*c* and the control signal Gt2*c*, to a gate terminal of the transistor 56*c* and a gate terminal of the transistor 57*c*, respectively. Furthermore, when the section signal S3 is at the low level, the gate driver 55*c* supplies the control signal Gt1*c* at a high-level voltage (a voltage in the vicinity of the power source voltage V4) to the gate terminal of the transistor 56*c*, supplies the control signal Gt2*c* at a low-level voltage (a voltage in the vicinity of the power source voltage V3) to the gate terminal of the transistor 57*c*, and sets both the transistors 56*c* and 57*c* to be off.

In the same manner, the gate driver 55*d* operates by being supplied with the power source voltage V4 in a low voltage range and the power source voltage V5 in a high voltage range, and generates control signals Gt1*d* and Gt2*d* that control switching operation of a transistor pair (hereinafter referred to as a "transistor pair that is made up of the transistors 56*d* and 57*d*") that includes the transistors 56*d* and 57*d*. Specifically, when the selection signal S4 is at the high level, the gate driver 55*d* increases the power source voltage V4 of each of the control signal VP and the control signal VN up to the range (the fourth range) of the power source voltages V5, and supplies the resulting control VP and control signal VN, as the control signal Gt1*d* and the control signal Gt2*d*, to a gate terminal of the transistor 56*d* and a gate terminal of the transistor 57*d*, respectively. Furthermore, when the section signal S4 is at the low level, the gate driver 55*d* supplies the control signal Gt1*d* at a high-level voltage (a voltage in the vicinity of the power source voltage V5) to the gate terminal of the transistor 56*d*, supplies the control signal Gt2*d* at a low-level voltage (a voltage in the vicinity of the power source voltage V4) to the gate terminal of the transistor 57*d*, and sets both the transistors 56*d* and 57*d* to be off.

In this manner, when each of the selection signals S1, S2, S3, and S4 are at the high level, logical levels of the control signals Gt1*a*, Gt1*b*, Gt1*c*, and Gt1*d* are consistent with a logical level of the control signal VP, and logical levels of the control signals Gt2*a*, Gt2*b*, Gt2*c*, and Gt2*d* are consistent with a logical level of the control signal VN. That is, the control signal VP is a signal that controls switching operation of each of the high-side transistors 56*a*, 56*b*, 56*c*, and 56*d*, and the control signal VN is a signal that controls switching operation of each of the low-side transistors 57*a*, 57*b*, 57*c*, and 57*d*. In other words, the gate driver control circuit 53 can be said to be a control signal generation circuit into which the output signal COMPO of the comparator 52 is input and which generates the control signal VP (an example of a "first control signal") that controls the switching operation of the high-side transistors 56*a*, 56*b*, 56*c*, and 56*d*, and the control signal VN (an example of a "second control signal") that controls the switching operation of the low-side transistors 57*a*, 57*b*, 57*c*, and 57*d*.

Each of the transistors 56*a* and 57*a*, the transistors 56*b* and 57*b*, the transistors 56*c* and 57*c*, and the transistors 56*d* and 57*d* are in a pair, and operate the switching operation. Specifically, the transistor 56*a* and the transistor 57*a* are serially connected between a power source voltage supply line to which the power source voltage V1 is applied and a power source voltage supply line to which the power source voltage V2 is applied, and thus constitute one transistor pair. Furthermore, the transistor 56*b* and the transistor 57*b* are serially connected between a power source voltage supply line to which the power source voltage V2 is applied and a power source voltage supply line to which the power source voltage V3 is applied, and thus constitute one transistor pair. Furthermore, the transistor 56*c* and the transistor 57*c* are serially connected between a power source voltage supply line to which the power source voltage V3 is applied and a power source voltage supply line to which the power source voltage V4 is applied, and thus constitute one transistor pair. Furthermore, the transistor 56*d* and the transistor 57*d* are serially connected between a power source voltage supply line to which the power source voltage V4 is applied and a power source voltage supply line to which the power source voltage V5 is applied, and thus constitute one transistor pair.

In the four transistor pairs, the high-side transistors 56*a*, 56*b*, 56*c*, and 56*d* are transistors that are set to be on when gate terminals thereof are at a low level and that are set to be off when the gate terminals thereof are at a high level, and, for example, are P channel type field effect transistors. Furthermore, the low-side transistors 57*a*, 57*b*, 57*c*, and 57*d* are transistors that are set to be on when gate terminals thereof are at the high level and that are set to be off when the gate terminals thereof are at the low level, and, for example, are N channel type field effect transistors.

In the transistor pair that is made up of the transistors 56*a* and 57*a*, the power source voltage V2 is applied to a source terminal of the high-side transistor 56*a*, the power source voltage V1 is applied to a source terminal of the low-side transistors 57*a*, and a drain terminal of the transistor 56*a* and a drain terminal of the transistor 57*a* are connected through a diode dp. The control signals Gt1*a* and Gt2*a*, which are output from the gate driver 55*a*, are supplied to gate terminals of the transistors 56*a* and 57*a*, respectively. Then, a connection node between a cathode terminal of the diode dp and the drain terminal of the transistor 57*a* is an output terminal of the transistor pair that is made up of the transistors 56*a* and 57*a*.

In the same manner, in the transistor pair that is made up of the transistors 56*b* and 57*b*, the power source voltage V3 is applied to a source terminal of the high-side transistor 56*b*, the power source voltage V2 is applied to a source terminal of the low-side transistors 57*b*, and a drain terminal of the transistor 56*b* and a drain terminal of the transistor 57*b* are connected through the diode dp and a diode dn. The control signals Gt1*b* and Gt2*b*, which are output from the gate driver 55*b*, are supplied to gate terminals of the transistors 56*b* and 57*b*, respectively. Then, a connection node between the cathode terminal of the diode dp and an anode terminal of the diode dn is an output terminal of the transistor pair that is made up of the transistors 56*b* and 57*b*.

In the same manner, in the transistor pair that is made up of the transistors 56*c* and 57*c*, the power source voltage V4 is applied to a source terminal of the high-side transistor 56*c*, the power source voltage V3 is applied to a source terminal of the low-side transistors 57*c*, and a drain terminal of the transistor 56*c* and a drain terminal of the transistor 57*c* are connected through the diode dp and the diode dn. The control signals Gt1*c* and Gt2*c*, which are output from the gate driver 55*c*, are supplied to gate terminals of the transistors 56*c* and 57*c*, respectively. Then, a connection node between the cathode terminal of the diode dp and the anode terminal of the diode dn is an output terminal of the transistor pair that is made up of the transistors 56*c* and 57*c*.

In the same manner, in the transistor pair that is made up of the transistors 56*d* and 57*d*, the power source voltage V5 is applied to a source terminal of the high-side transistor 56*d*, the power source voltage V4 is applied to a source terminal of the low-side transistors 57*d*, and a drain terminal of the transistor 56*d* and a drain terminal of the transistor 57*d* are connected through the diode dn. The control signals Gt1*d* and Gt2*d*, which are output from the gate driver 55*d*, are supplied to gate terminals of the transistors 56*d* and 57*d*, respectively. Then, a connection node between the drain terminal of the transistor 56*d* and the anode terminal of the diode dn is an output terminal of the transistor pair that is made up of the transistors 56*d* and 57*d*.

The output terminal of the transistor pair that is made up of the transistors 56*a* and 57*a*, the output terminal of the transistor pair that is made up of the transistors 56*b* and 57*b*, the output terminal of the transistor pair that is made up of the transistors 56*c* and 57*c*, and the output terminal of the transistor pair that is made up of the transistors 56*d* and 57*d* are connected to each other, the connection node is an output node N1 of the drive circuit 50, and a signal that is output from the output node N1 is the drive signal COMA (COMB).

The diode dp is a diode for preventing current (reverse flow) that flows from the out node N1 to a supply line for each of the power source voltages V2, V3, and V4 through the transistors 56*a*, 56*b*, and 56*c*, and a forward direction of the current is a direction from the drain terminal of each of the transistors 56*a*, 56*b*, and 56*c* to the output node N1. Furthermore, the diode dn is a diode for preventing current (reverse flow from a supply line for each of the power source voltages V2, V3, and V4 to the output node N1 through the transistors 57*b*, 57*c*, and 57*d*, and a forward direction of the current is a direction from the output node N1 to the drain terminal of each of the transistors 57*b*, 57*c*, and 57*d*. It is noted that, because a voltage (a voltage of the drive signal COMA (COMB)) of the output N1 is not higher than power source voltage V5, current (reverse flow) that flows from the output node N1 to the supply line for the power source voltage V5 does not occur. For this reason, the diode dp is not provided for the transistor 56*d*. In the same manner, because the voltage (the voltage of the drive signal COMA (COMB)) of the output N1 is not lower than power source voltage V1, current (reverse flow) that flows from a supply line for the power source voltage V1 to the output node N1 does not occur. For this reason, the diode dn is not provided for the transistor 57*a*.

It is noted that, when a state is attained where the control signal VP is at the low level and the control signal VN is at the high level, there is a concern that the transistors 56*a* and 57*a*, the transistors 56*b* and 57*b*, the transistors 56*c* and 57*c*, or the transistors 56*d* and 57*d* will be both set to be on, that more through-current will flow from any one of the supply lines for the power source voltages V2 to V4 to the supply line for the power source voltage V1, and that the drive circuit 50 will malfunction. Therefore, the control signal VP is at the low level in such a manner that this through-current does not occur, and the gate driver control circuit 53 needs to be configured in such a manner that a state where the control signal VN is at the high level is not attained.

Figure 13:
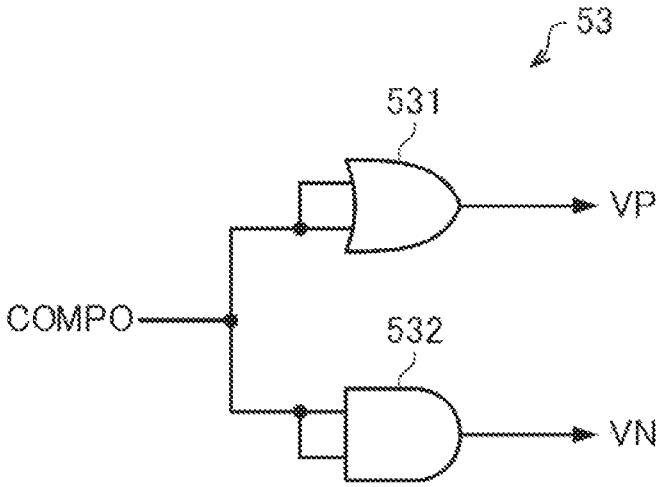
FIG. 13 is a diagram illustrating an example of a configuration of a gate driver control circuit.

FIG. 13 is a diagram illustrating an example of a configuration of the gate driver control circuit 53. In an example that is illustrated in FIG. 13, the gate driver control circuit 53 is configured to include a two-input OR circuit 531 and a two-input AND circuit 532. Two input terminals of the OR circuit 531 are short-circuited. In the same manner, two input terminals of the AND circuit 532 are short-circuited. Then, the output signal COMPO of the comparator 52 is input into the OR circuit 531 and the AND circuit 532, the control signal VP is output from an output terminal of the OR circuit 531, and the control signal VN is output from an output terminal of the AND circuit 532.

Figure 14:
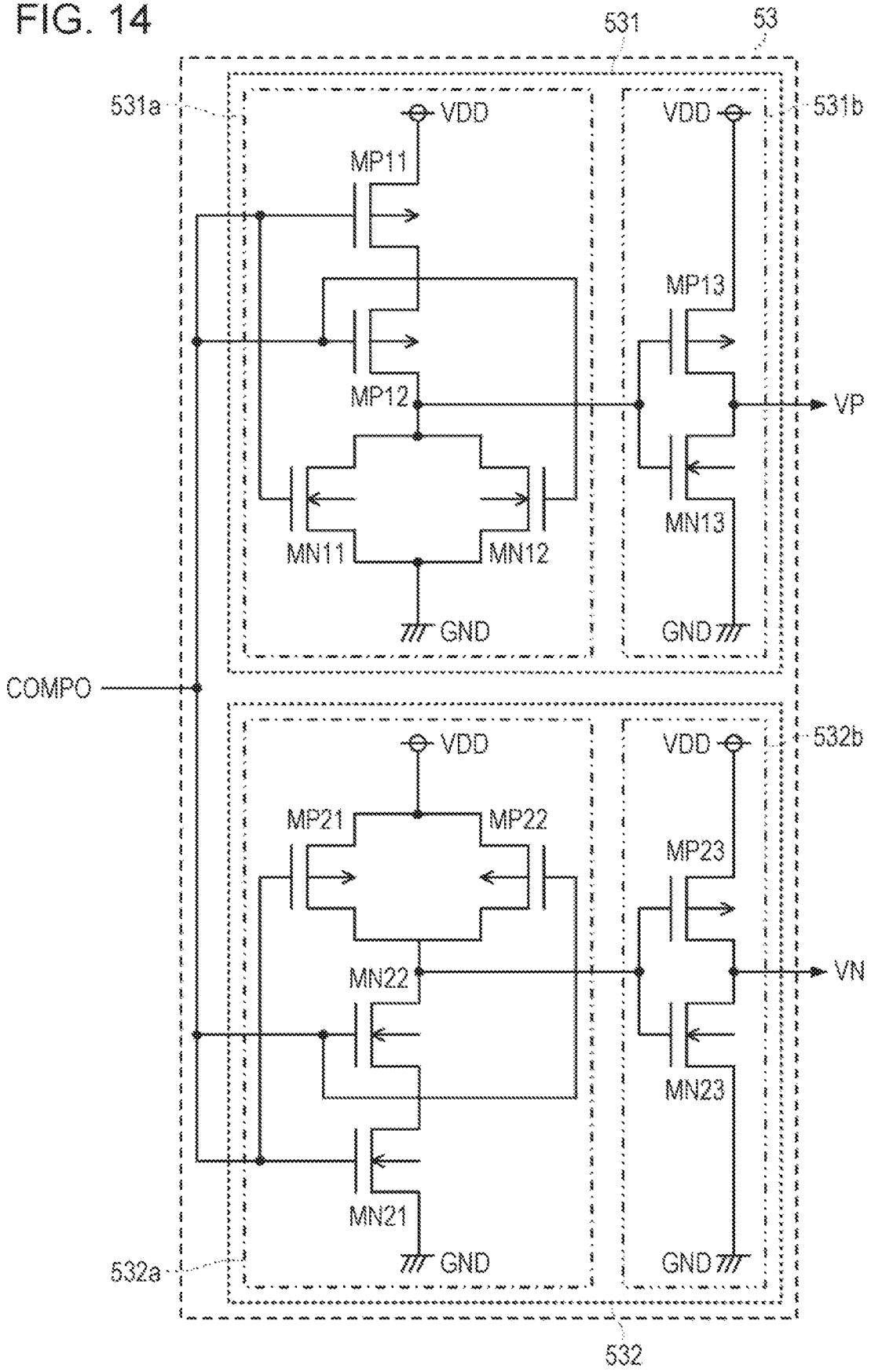
FIG. 14 is a diagram illustrating detailed configurations of an OR circuit and an AND circuit.

FIG. 14 is a diagram illustrating detailed configurations of the OR circuit 531 and the AND circuit 532. As illustrated in FIG. 14, the OR circuit 531 is configured with a NOR circuit 531*a* and a CMOS inverter (a NOT circuit) 531*b* that is connected to the latter portion thereof.

The NOR circuit 531*a* includes two P channel-type MOS transistors, P channel-type MOS transistors MP11 and MP12, and two N channel-type MOS transistors, N channel-type MOS transistors MN11 and MN12. The low power source voltage VDD is supplied to a source terminal of the MOS transistor MP11. A drain terminal of the MOS transistor MP11 is connected to a source terminal of the MOS transistor MP12. A drain terminal of the MOS transistor MP12 is connected to a drain terminal of each of the MOS transistors MN11 and MN12, and this node is an output terminal of the NOR circuit 531*a*. The ground voltage GND is supplied to a source terminal of each of the MOS transistors MN11 and MN12. A gate terminal of the MOS transistor MP11 and a gate terminal of the MOS transistor MN11 are connected, and this node is a first input terminal of the NOR circuit 531*a*. A gate terminal of the MOS transistor MP12 and a gate terminal of the MOS transistors MN12 are connected, and this node is a second input terminal of the NOR circuit 531*a*.

The CMOS inverter 531*b* includes a P channel-type MOS transistor MP13 and an N channel-type MOS transistor MN13. The low power source voltage VDD is supplied to a source terminal of the MOS transistor MP13. A drain of the MOS transistor MP13 is connected to a drain terminal of the MOS transistor MN13, and this node is an output terminal of the CMOS inverter 531*b*. The ground voltage GND is supplied to a source terminal of the MOS transistor MN13. A gate terminal of the MOS transistor MP13 and a gate terminal of the MOS transistor MN13 are connected, and this node is an input terminal of the CMOS inverter 531*b*. The input terminal of the CMOS inverter 531*b* is connected to the output terminal of the NOR circuit 531*a*.

Then, a first input terminal and a second input terminal of the NOR circuit 531*a* are two input terminals (examples of the "first input terminal" and the "second input terminal") of the OR circuit 531, and the two input terminals are short-circuited and the output signal COMPO of the comparator 52 is input. Furthermore, the output terminal of the CMOS inverter 531*b* is the output terminal of the OR circuit 531, and the control signal VP is output from the output terminal thereof.

Furthermore, as illustrated in FIG. 14, the AND circuit 532 is configured with a NAND circuit 532*a* and a CMOS inverter (a NOT circuit) 532*b* that is connected to the latter portion thereof.

The NAND circuit 532*a* includes two P channel-type MOS transistors, P channel-type MOS transistors MP21 and MP22, and two N channel-type MOS transistors, N channel-type MOS transistors MN21 and MN22. The low power source voltage VDD is supplied to a source terminal of the MOS transistor MP21 and a source terminal of the MOS transistor MP22. A drain terminal of each of the MOS transistors MP21 and MP22 is connected to a drain terminal of the MOS transistor MN22, and this node is an output terminal of the NAND circuit 532*a*. A source terminal of the MOS transistor MN22 is connected to a drain terminal of the MOS transistor MN21. The ground voltage GND is supplied to a source terminal of the MOS transistor MN21. A gate terminal of the MOS transistor MP21 and a gate terminal of the MOS transistors MN21 are connected, and this node is a first input terminal of the NAND circuit 532*a*. A gate terminal of the MOS transistor MP22 and a gate terminal of the MOS transistors MN22 are connected, and this node is a second input terminal of the NAND circuit 532*a*.

The CMOS inverter 532*b* includes a P channel-type MOS transistor MP23 and an N channel-type MOS transistor MN23. The low power source voltage VDD is supplied to a source terminal of the MOS transistor MP23. A drain of the MOS transistor MP23 is connected to a drain terminal of the MOS transistor MN23, and this node is an output terminal of the CMOS inverter 532*b*. The ground voltage GND is supplied to a source terminal of the MOS transistor MN23. A gate terminal of the MOS transistor MP23 and a gate terminal of the MOS transistor MN23 are connected, and this node is an input terminal of the CMOS inverter 532*b*. The input terminal of the CMOS inverter 532*b* is connected to the output terminal of the NAND circuit 532*a*.

Then, a first input terminal and a second input terminal of the NAND circuit 532*a* are two input terminals (examples of a "third input terminal" and a "fourth input terminal") of the AND circuit 532, and the two input terminals are short-circuited and the output signal COMPO of the comparator 52 is input. Furthermore, the output terminal of the CMOS inverter 532*b* is the output terminal of the AND circuit 532, and the control signal VN is output from the output terminal thereof.

At this point, sizes (W/L) of four MOS transistors, the MOS transistors MP11, MP12, MN11, and MN12, which are included in the NOR circuit 531*a*, are set to be the same. In this case, when the output signal COMPO of the comparator changes from the low level to the high level, two MOS transistors, the MOS transistors MP11 and MP12 are off, and two MOS transistors, the MOS transistors MN11 and MN12, are set to be on. Thus, current flows in parallel through two MOS transistors, the MOS transistors MN11 and MN12. As a result, the output terminal of the NOR circuit 531*a* changes from the high level to the low level. On the other hand, when the output signal COMPO of the comparator 52 changes from the high level to the low level, two MOS transistors, the MOS transistors MN11 and MN12 are off, and two MOS transistors, the MOS transistors MP11 and MP12, are set to be on. Thus, current flows in series through two MOS transistors, the MOS transistors MP11 and MP12. As a result, the output terminal of the NOR circuit 531*a* changes from the low level to the high level. That is, when the output signal COMPO of the comparator 52 changes from the low level to the high level, current flows in parallel through two MOS transistors, the MOS transistors MN11 and MN12. In contrast, when the output signal COMPO of the comparator 52 changes from the high level to the low level, two MOS transistors, current flows in series through two MOS transistors, the MOS transistors MP11 and MP12. Because of this, in the former case, a voltage of the output terminal of the NOR circuit 531*a* changes quickly. Therefore, a logical threshold of the NOR circuit 531*a* is smaller than VDD/2. Then, when sizes (W/L) two MOS transistors, the MOS transistors MP13 and MN13, which are included in the CMOS inverter 531*b*, are set to be the same, a logical threshold of the CMOS inverter 531*b* is almost VDD/2. Because of this, in the end, a logical threshold of the OR circuit 531 is smaller than VDD/2.

Furthermore, sizes (W/L) of four MOS transistors, the MOS transistors MP21, MP22, MN21, and MN22, which are included in the NAND circuit 532*a*, are set to be the same. In this case, when the output signal COMPO of the comparator changes from the low level to the high level, two MOS transistors, the MOS transistors MP21 and MP22 are set to be off, and two MOS transistors, the MOS transistors MN21 and MN22, are set to be on. Thus, current flows in serial through two MOS transistors, the MOS transistors MN21 and MN22. As a result, the output terminal of the NAND circuit 532*a* changes from the high level to the low level. On the other hand, when the output signal COMPO of the comparator changes from the high level to the low level, two MOS transistors, the MOS transistors MN21 and MN22 are set to be off, and two MOS transistors, the MOS transistors MP21 and MP22, are set to be on. Thus, current flows in parallel through two MOS transistors, the MOS transistors MP21 and MP22. As a result, the output terminal of the NAND circuit 532*a* changes from the low level to the high level. That is, when the output signal COMPO of the comparator 52 changes from the low level to the high level, current flows in series through two MOS transistors, the MOS transistors MN21 and MN22. In contrast, when the output signal COMPO of the comparator 52 changes from the high level to the low level, two MOS transistors, current flows in parallel through two MOS transistors, the MOS transistors MP21 and MP22. Because of this, in the latter case, a voltage of the output terminal of the NAND circuit 532*a* changes quickly. Therefore, a logical threshold of the NAND circuit 532*a* is greater than VDD/2. Then, when sizes (W/L) of two MOS transistors, the MOS transistors MP23 and MN23, which are included in the CMOS inverter 532*b*, are set to be the same, a logical threshold of the CMOS inverter 532*b* is almost VDD/2. Because of this, in the end, a logical threshold of the AND circuit 532 is greater than VDD/2.

Figure 15:
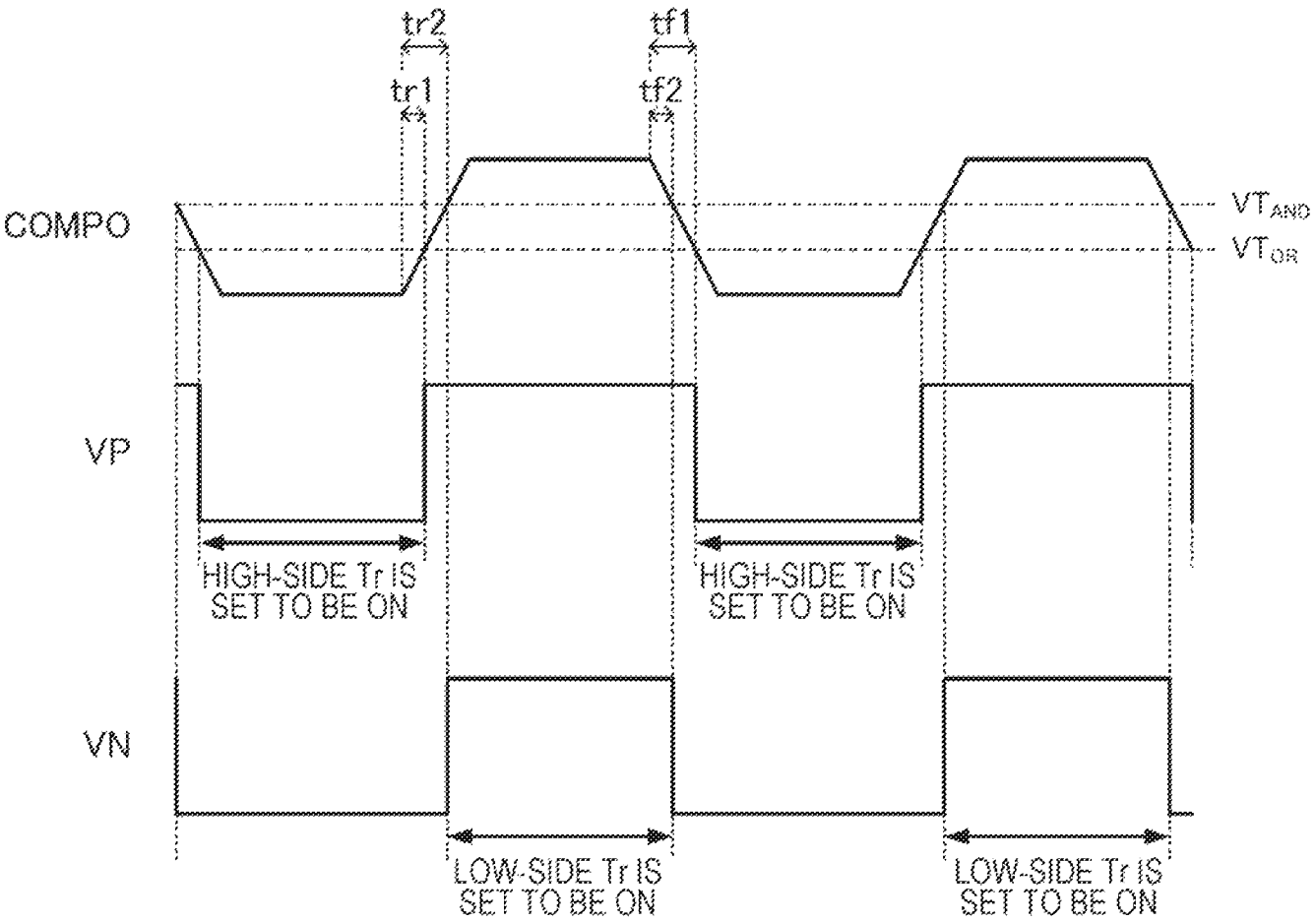
FIG. 15 is a diagram illustrating an output waveform of the OR circuit and an output waveform of the AND circuit.

In this manner, the logical threshold of the OR circuit 531 is smaller than the logical threshold of the AND circuit 532. Therefore, as illustrated in FIG. 15, when the output signal COMPO of the comparator 52 changes from the low level to the high level, the OR circuit 531 operates at a higher speed than the AND circuit 532. Because of this, time tr1 for which the control signal VP is on the rising edge is shorter than time tr2 for which the control signal VN is on the rising edge. Conversely, when the output signal COMPO of the comparator 52 changes from the high level to the low level, the AND circuit 532 operates at a higher speed than the OR circuit 531. Because of this, time tf2 for which the control signal VN is on the falling edge is shorter than time tf1 for which the control signal VP is on the falling edge. For this reason, a state is not attained where the control signal VP is at the low level and the control signal VN is at the high level, and thus, there is a decreased concern that the transistors 56*a* and 57*a*, the transistors 56*b* and 57*b*, the transistors 56*c* and 57*c*, or the transistors 56*d* and 57*d* will be both set to be on, and that through-current will flow from any one of the supply lines for the power source voltages V2 to V4 to the supply line for the power source voltage V1.

The greater a difference between time tr2 for which the control signal VN is on the rising edge and time tr1 for which the control signal VP is on the rising edge or a difference between time to for which the control signal VP is on the falling edge and time tf2 for which the control signal VN is on the falling edge, the more difficult it is for through-current to flow. However, because the time for which the control signal VP is at the high level and the control signal VN is at the low level is lengthened, the similarity of the change in the voltage of the drive signal COMA (COMB) to the change in the voltage of the source drive signal ain (bin) is low, and the precision of a waveform of the drive signal COMA (COMB) decreases. Therefore, considering this trade-off, it is desirable that time tr1 for which the control signal VP is on the rising edge and time to for which the control signal VP is on the falling edge, or time tr2 for which the control signal VN is on the rising edge and time tf2 for which the control signal VN is on the falling edge are adjusted to suitable times.

It is noted that the logical threshold of the OR circuit 531 is changed and thus time tr1 for which the control signal VP is on the rising edge and time tf1 for which the control signal VP is on the falling edge can be changed, and that the number of or sizes (W/L) of MOS transistors which are included in the NOR circuit 531*a* are changed and thus the logical threshold of the OR circuit 531 can be changed. In the same manner, the logical threshold of the AND circuit 532 is changed and thus time tr2 for which the control signal VN is on the rising edge and time tf2 for which the control signal VN is on the falling edge can be changed, and the number of or sizes (W/L) of MOS transistors which are included in the NAND circuit 532*a* are changed and thus the logical threshold of the AND circuit 532 can be changed.

7. OPERATION OF THE DRIVE CIRCUIT

Next, operation of the drive circuit 50 will be described. The operation of the drive circuit 50*a* that outputs the drive signal COMA will be described below, but the same is true for operation of the drive circuit 50*b* that outputs the drive signal COMB.

Figure 16:
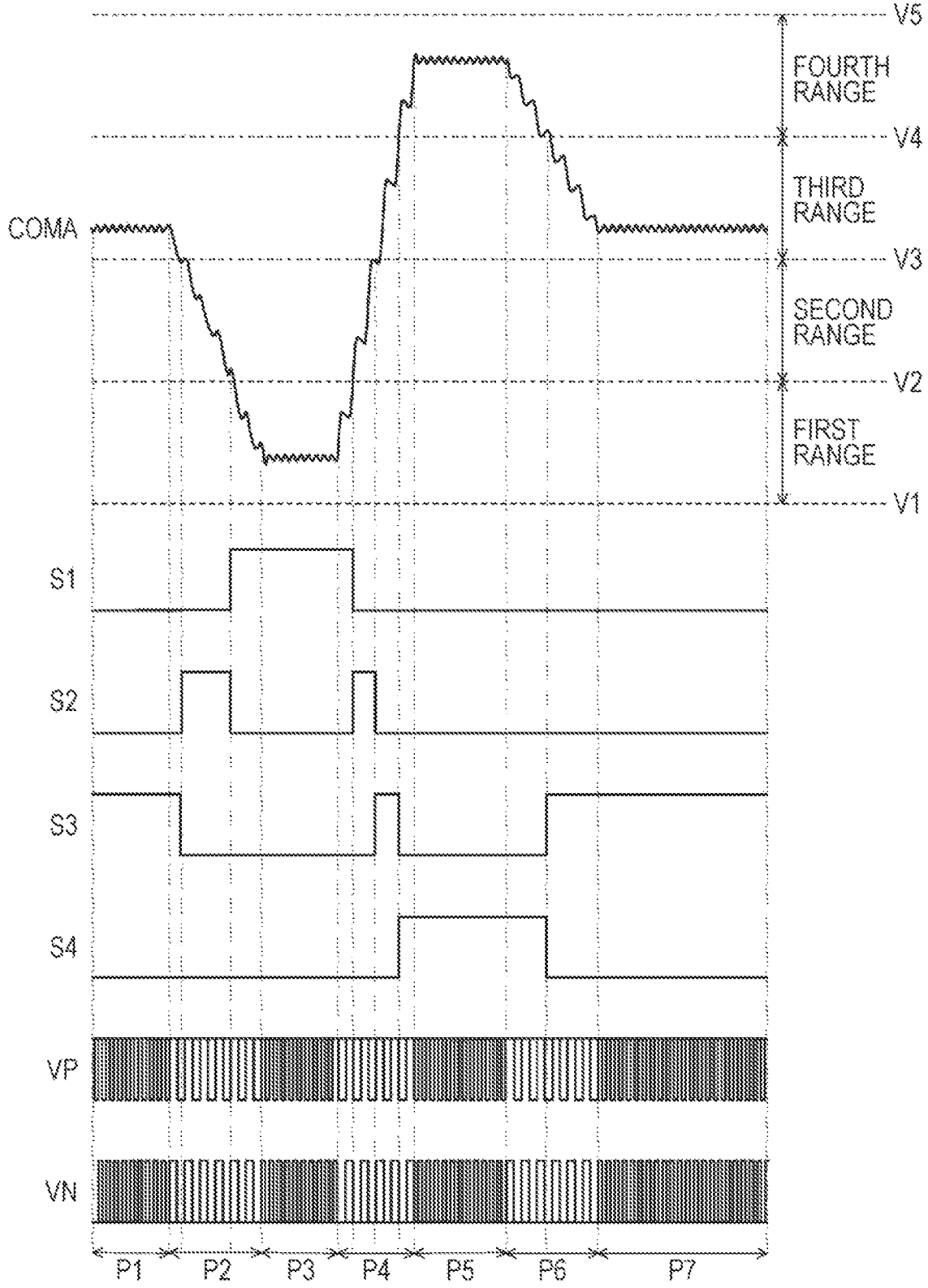
FIG. 16 is a diagram for describing operation of the drive circuit.

FIG. 16 is a diagram for describing the operation of the drive circuit 50 (50*a*). As illustrated in FIG. 16, during the duration T1 at the periodicity Ta, during a duration P1, a voltage of the drive signal COMA in accordance with the drive data dA is in the third range. Because of this, the selection signal S3 is at the high level, and the selections signals S1, S2, and S4 are at the low level. Because the selection signals S1, S2, and S4 are at the low level, the control signals Gt1*a*, Gt1*b*, and Gt1*d* are at the high level, the control signals Gt2*a*, Gt2*b*, and Gt2*d* are at the low level, and thus, any one of the transistors 56*a*, 56*b*, 56*d*, 57*a*, 57*b*, and 57*d* is set to be off. On the other hand, because the selection signal S3 is at the high level, logical levels of the control signal Gt1*c* and Gt2*c* are consistent with a logical level (logical levels of the control signals VP and VN) of the output signal COMPO of the comparator 52. Because of this, one of the transistors 56*c* and 57*c* is set to be on and the other one is set to be off.

Specifically, if the output signal COMPO of the comparator 52 is at the low level, the control signals VP and VN are at the low level and the control signals Gt1*c* and Gt2*c* are also at the low level. Because of this, the transistor 56*c* is set to be on, and the transistor 57*c* is set to be off. Accordingly, electric charge is transferred from the supply line for the power source voltage V3 to the capacitor C0 for charging, and the voltage of the drive signal COMA rises. During the duration P1, when a voltage of the source drive signal ain is constant and the voltage of the drive signal COMA rises, a voltage of the feedback signal ain2 also rises and thus becomes higher than a voltage of the source drive signal ain. Because of this, the output signal COMPO of the comparator 52 is at the high level. For this reason, the control signals VP and VN are at the high level and the control signals Gt1*c* and Gt2*c* are also at the high level. Because of this, the transistor 56*c* is set to be off, and the transistor 57*c* is set to be on. Accordingly, one portion of an amount of electric charge that is stored up in the capacitor C0 is released to the supply line for the power source voltage V3, and the voltage of the drive signal COMA drops. When the voltage of the drive signal COMA drops, the voltage of the feedback signal ain2 also drops and thus becomes lower than the voltage of the source drive signal ain. Because of this, the output signal COMPO of the comparator 52 is at the low level. For this reason, the control signals VP and VN are at the low level and the control signals Gt1*c* and Gt2*c* are also at the low level. Because of this, the transistor 56*c* is set to be on, and the transistor 57*c* is set to be off. Accordingly, electric charge is transferred from the supply line for the power source voltage V3 to the capacitor C0 for charging, and the voltage of the drive signal COMA rises. In this manner, during the duration P1, the transistors 56*c* and 57*c* are alternately set to be on, and thus the voltage of the drive signal COMA repeatedly rises and drops in the vicinity of a given voltage in accordance with the voltage (a constant voltage) of the source drive signal ain.

During a duration P2 subsequent to the duration P1, when the voltage of the source drive signal ain drops based on the drive data dA and becomes lower than the feedback signal ain2, the output signal COMPO of the comparator 52 is at the high level. For this reason, the control signals VP and VN are at the high level and the control signals Gt1*c* and Gt2*c* are also at the high level. Because of this, the transistor 56*c* is set to be off, and the transistor 57*c* is set to be on. Accordingly, one portion of an amount of electric charge that is stored up in the capacitor C0 is released to the supply line for the power source voltage V3, and the voltage of the drive signal COMA drops and the voltage of the feedback signal ain2 also drops. During the duration P2, the voltage of the source drive signal ain drops, but the voltage of the feedback signal ain2 drops rapidly and becomes lower than the voltage of the source drive signal ain. Because of this, the output signal COMPO of the comparator 52 is at the low level. For this reason, the control signals VP and VN are at the low level and the control signals Gt1*c* and Gt2*c* are also at the low level. Because of this, the transistor 56*c* is set to be on, and the transistor 57*c* is set to be off. Accordingly, electric charge is transferred from the supply line for the power source voltage V3 to the capacitor C0 for charging, and the voltage of the drive signal COMA rises. When the voltage of the drive signal COMA rises, the voltage of the feedback signal ain2 also rises and thus becomes higher than the voltage of the source drive signal ain. Because of this, the output signal COMPO of the comparator 52 is at the high level. For this reason, the control signals VP and VN are at the high level and the control signals Gt1*c* and Gt2*c* are also at the high level. Because of this, the transistor 56*c* is set to be off, and the transistor 57*c* is set to be on. Accordingly, one portion of an amount of electric charge that is stored up in the capacitor C0 is released to the supply line for the power source voltage V3, and the voltage of the drive signal COMA drops. In this manner, the transistors 56*c* and 57*c* are alternately set to be on, and the voltage of the drive signal COMA drops while repeatedly rising and dropping, as the voltage of the source drive signal ain drops.

Then, when the voltage of the drive signal COMA drops until it falls within the second range, the selection signal S2 is at the high level, and the selection signals S1, S3, and S4 are at the low level. Because the selection signals S1, S3, and S4 are at the low level, the control signals Gt1*a*, Gt1*c*, and Gt1*d* are at the high level, the control signals Gt2*a*, Gt2*c*, and Gt2*d* are at the low level, and thus, any one of the transistors 56*a*, 56*c*, 56*d*, 57*a*, 57*c*, and 57*d* is set to be off. On the other hand, because the selection signal S2 is at the high level, logical levels of the control signal Gt1*b* and Gt2*b* are consistent with the logical level (the logical levels of the control signals VP and VN) of the output signal COMPO of the comparator 52. Because of this, one of the transistors 56*b* and 57*b* is set to be on and the other one is set to be off. Specifically, the transistors 56*b* and 57*b* are alternately set to be on. Thus, the transferring of electric charge from the supply line for the power source voltage V2 to the capacitor C0 for charging and the releasing of electric charge from the capacitor C0 to the supply line for the power source voltage V2 are repeated alternately, and the voltage of the drive signal COMA drops while repeatedly rising and dropping, as the voltage of the source drive signal ain drops.

Moreover, when the voltage of the drive signal COMA drops until it falls within the first range, the selection signal S1 is at the high level, and the selection signals S2, S3, and S4 are at the low level. Because the selection signals S2, S3, and S4 are at the low level, the control signals Gt1*b*, Gt1*c*, and Gt1*d* are at the high level, the control signals Gt2*b*, Gt2*c*, and Gt2*d* are at the low level, and thus, any one of the transistors 56*b*, 56*c*, 56*d*, 57*b*, 57*c*, and 57*d* is set to be off. On the other hand, because the selection signal S1 is at the high level, logical levels of the control signal Gt1*a* and Gt2*a* are consistent with the logical level (the logical levels of the control signals VP and VN) of the output signal COMPO of the comparator 52. Because of this, one of the transistors 56*a* and 57*a* is set to be on and the other one is set to be off. Specifically, the transistors 56*a* and 57*a* are alternately set to be on. Thus, the transferring of electric charge from the supply line for the power source voltage V1 to the capacitor C0 for charging and the releasing of electric charge from the capacitor C0 to the supply line for the power source voltage V1 are repeated alternately, and the voltage of the drive signal COMA drops while repeatedly rising and dropping, as the voltage of the source drive signal ain drops.

During a duration P3 subsequent to the duration P2, because the voltage of the drive signal COMA is in the first range, any one of the transistors 56*b*, 56*c*, 56*d*, 57*b*, 57*c*, and 57*d* is set to be off, and one of the transistors 56*a* and 57*a* is set to be on and the other is set to be off. Specifically, the transistors 56*a* and 57*a* are alternately set to be on. Thus, the transferring of electric charge from the supply line for the power source voltage V1 to the capacitor C0 for charging and the releasing of electric charge from the capacitor C0 to the supply line for the power source voltage V1 are repeated alternately, and the voltage of the drive signal COMA repeatedly rises and drops in the vicinity of a given voltage in accordance with the voltage (a constant voltage) of the voltage of the source drive signal ain.

During a duration P4 subsequent to the duration P3, when the voltage of the source drive signal ain rises based on the drive data dA and becomes higher than the feedback signal ain2, the output signal COMPO of the comparator 52 is at the low level. For this reason, the control signals VP and VN are at the low level and the control signals Gt1*a* and Gt2*a* are also at the low level. Because of this, the transistor 56*a* is set to be on, and the transistor 57*a* is set to be off. Accordingly, electric charge is transferred from the supply line for the power source voltage V1 to the capacitor C0 for charging, and the voltage of the drive signal COMA rises, and the voltage of the feedback signal ain2 also rises. During the duration P4, the voltage of the source drive signal ain rises, but the voltage of the feedback signal ain2 rises rapidly and becomes higher than the voltage of the source drive signal ain. Because of this, the output signal COMPO of the comparator 52 is at the high level. For this reason, the control signals VP and VN are at the high level and the control signals Gt1*a* and Gt2*a* are also at the high level. Because of this, the transistor 56*a* is set to be off, and the transistor 57*a* is set to be on. Accordingly, one portion of an amount of electric charge that is stored up in the capacitor C0 is released to the supply line for the power source voltage V1, and the voltage of the drive signal COMA drops. When the voltage of the drive signal COMA drops, the voltage of the feedback signal ain2 also drops and thus becomes lower than the voltage of the source drive signal ain. Because of this, the output signal COMPO of the comparator 52 is at the low level. For this reason, the control signals VP and VN are at the low level and the control signals Gt1*c* and Gt2*c* are also at the low level. Because of this, the transistor 56*a* is set to be on, and the transistor 57*a* is set to be off. Accordingly, electric charge is transferred from the supply line for the power source voltage V1 to the capacitor C0 for charging, and the voltage of the drive signal COMA rises. In this manner, the transistors 56*a* and 57*a* are alternately set to be on, and the voltage of the drive signal COMA rises while repeatedly rising and dropping, as the voltage of the source drive signal ain rises.

Then, when the voltage of the drive signal COMA rises until it falls within the second range, the selection signal S2 is at the high level, and the selection signals S1, S3, and S4 are at the low level. Because the selection signals S1, S3, and S4 are at the low level, the control signals Gt1*a*, Gt1*c*, and Gt1*d* are at the high level, the control signals Gt2*a*, Gt2*c*, and Gt2*d* are at the low level, and thus, any one of the transistors 56*a*, 56*c*, 56*d*, 57*a*, 57*c*, and 57*d* is set to be off. On the other hand, because the selection signal S2 is at the high level, the logical levels of the control signal Gt1*b* and Gt2*b* are consistent with the logical level (the logical levels of the control signals VP and VN) of the output signal COMPO of the comparator 52. Because of this, one of the transistors 56*b* and 57*b* is set to be on and the other one is set to be off. Specifically, the transistors 56*b* and 57*b* are alternately set to be on. Thus, the transferring of electric charge from the supply line for the power source voltage V2 to the capacitor C0 for charging and the releasing of electric charge from the capacitor C0 to the supply line for the power source voltage V2 are repeated alternately, and the voltage of the drive signal COMA rises while repeatedly rising and dropping, as the voltage of the source drive signal ain rises.

Moreover, when the voltage of the drive signal COMA rises until it falls within the third range, the selection signal S3 is at the high level, and the selection signals S1, S2, and S4 are at the low level. Because the selection signals S1, S2, and S4 are at the low level, the control signals Gt1*a*, Gt1*b*, and Gt1*d* are at the high level, the control signals Gt2*a*, Gt2*b*, and Gt2*d* are at the low level, and thus, any one of the transistors 56*a*, 56*b*, 56*d*, 57*a*, 57*b*, and 57*d* is set to be off. On the other hand, because the selection signal S3 is at the high level, the logical levels of the control signal Gt1*c* and Gt2*c* are consistent with the logical level (the logical levels of the control signals VP and VN) of the output signal COMPO of the comparator 52. Because of this, one of the transistors 56*c* and 57*c* is set to be on and the other one is set to be off. Specifically, the transistors 56*c* and 57*c* are alternately set to be on. Thus, the transferring of electric charge from the supply line for the power source voltage V3 to the capacitor C0 for charging and the releasing of electric charge from the capacitor C0 to the supply line for the power source voltage V3 are repeated alternately, and the voltage of the drive signal COMA rises while repeatedly rising and dropping, as the voltage of the source drive signal ain rises.

Moreover, when the voltage of the drive signal COMA rises until it falls within the fourth range, the selection signal S4 is at the high level, and the selection signals S1, S2, and S3 are at the low level. Because the selection signals S1, S2, and S3 are at the low level, the control signals Gt1*a*, Gt1*b*, and Gt1*c* are at the high level, the control signals Gt2*a*, Gt2*b*, and Gt2*c* are at the low level, and thus, any one of the transistors 56*a*, 56*b*, 56*c*, 57*a*, 57*b*, and 57*c* is set to be off. On the other hand, because the selection signal S4 is at the high level, logical levels of the control signal Gt1*d* and Gt2*d* are consistent with the logical level (the logical levels of the control signals VP and VN) of the output signal COMPO of the comparator 52. Because of this, one of the transistors 56*d* and 57*d* is set to be on and the other one is set to be off.

Specifically, the transistors 56*d* and 57*d* are alternately set to be on. Thus, the transferring of electric charge from the supply line for the power source voltage V4 to the capacitor C0 for charging and the releasing of electric charge from the capacitor C0 to the supply line for the power source voltage V4 are repeated alternately, and the voltage of the drive signal COMA rises while repeatedly rising and dropping, as the voltage of the source drive signal ain rises.

During a duration P5 subsequent to the duration P4, because the voltage of the drive signal COMA is in the fourth range, any one of the transistors 56*a*, 56*b*, 56*c*, 57*a*, 57*b*, and 57*c* is set to be off, and one of the transistors 56*d* and 57*d* is set to be on and the other is set to be off. Specifically, the transistors 56*d* and 57*d* are alternately set to be on. Thus, the transferring of electric charge from the supply line for the power source voltage V4 to the capacitor C0 for charging and the releasing of electric charge from the capacitor C0 to the supply line for the power source voltage V4 are repeated alternately, and the voltage of the drive signal COMA repeatedly rises and drops in the vicinity of a given voltage in accordance with the voltage (a constant voltage) of the voltage of the source drive signal ain.

During a duration P6 subsequent to the duration P5, when the voltage of the drive signal COMA is in the fourth range, any one of the transistors 56*a*, 56*b*, 56*c*, 57*a*, 57*b*, and 57*c* is set to be off, and one of the transistors 56*d* and 57*d* is set to be on and the other is set to be off. Specifically, the transistors 56*d* and 57*d* are alternately set to be on. Thus, the transferring of electric charge from the supply line for the power source voltage V4 to the capacitor C0 for charging and the releasing of electric charge from the capacitor C0 to the supply line for the power source voltage V4 are repeated alternately, and the voltage of the drive signal COMA drops while repeatedly rising and dropping, as the voltage of the source drive signal ain drops. Then, because the voltage of the drive signal COMA drops until it falls within the third range, any one of the transistors 56*a*, 56*b*, 56*d*, 57*a*, 57*b*, and 57*d* is set to be off, and one of the transistors 56*c* and 57*c* is set to be on and the other is set to be off. Specifically, the transistors 56*c* and 57*c* are alternately set to be on. Thus, the transferring of electric charge from the supply line for the power source voltage V3 to the capacitor C0 for charging and the releasing of electric charge from the capacitor C0 to the supply line for the power source voltage V3 are repeated alternately, and the voltage of the drive signal COMA drops while repeatedly rising and dropping, as the voltage of the source drive signal ain drops.

During a duration P7 subsequent to the duration P6, because the voltage of the drive signal COMA is in the third range, any one of the transistors 56*a*, 56*b*, 56*d*, 57*a*, 57*b*, and 57*d* is set to be off, and one of the transistors 56*c* and 57*c* is set to be on and the other is set to be off. Specifically, the transistors 56*c* and 57*c* are alternately set to be on. Thus, the transferring of electric charge from the supply line for the power source voltage V3 to the capacitor C0 for charging and the releasing of electric charge from the capacitor C0 to the supply line for the power source voltage V3 are repeated alternately, and the voltage of the drive signal COMA repeatedly rises and drops in the vicinity of a given voltage in accordance with the voltage (a constant voltage) of the voltage of the source drive signal ain.

In this manner, in the drive circuit 50 according to the present embodiment, with the switching operation of each of the transistors 56*a* to 56*d* and 57*a* to 57*d* in accordance with the drive data dA(dB), the transferring of electric charge to the capacitor C0 for charging and the releasing of electric charge from the capacitor C0 are performed and thus the voltage of the drive signal COMA (COMB) rises or drops. At this time, the transistors that operate for switching are in any one of the transistor pair that is made up of the transistors 56*a* and 57*a*, the transistor pair that is made up of the transistors 56*b* and 57*b*, the transistor pair that is made up of the transistors 56*c* and 57*c*, and the transistor pair that is made up of the transistors 56*d* and 57*d*, and the other transistor pairs are off. Then, because voltages that are applied to both terminals of the four transistor pairs are V5-V4, V4-V3, V3-V2, and V2-V1 (any one of which is 10.5 V), respectively, an amount of current at the time of the switching is greatly reduced when voltage drops in the diode dp and the diode do are ignored, compared with a configuration in which one transistor pair operates at V5-V1 (42 V) for switching.

Figure 19:
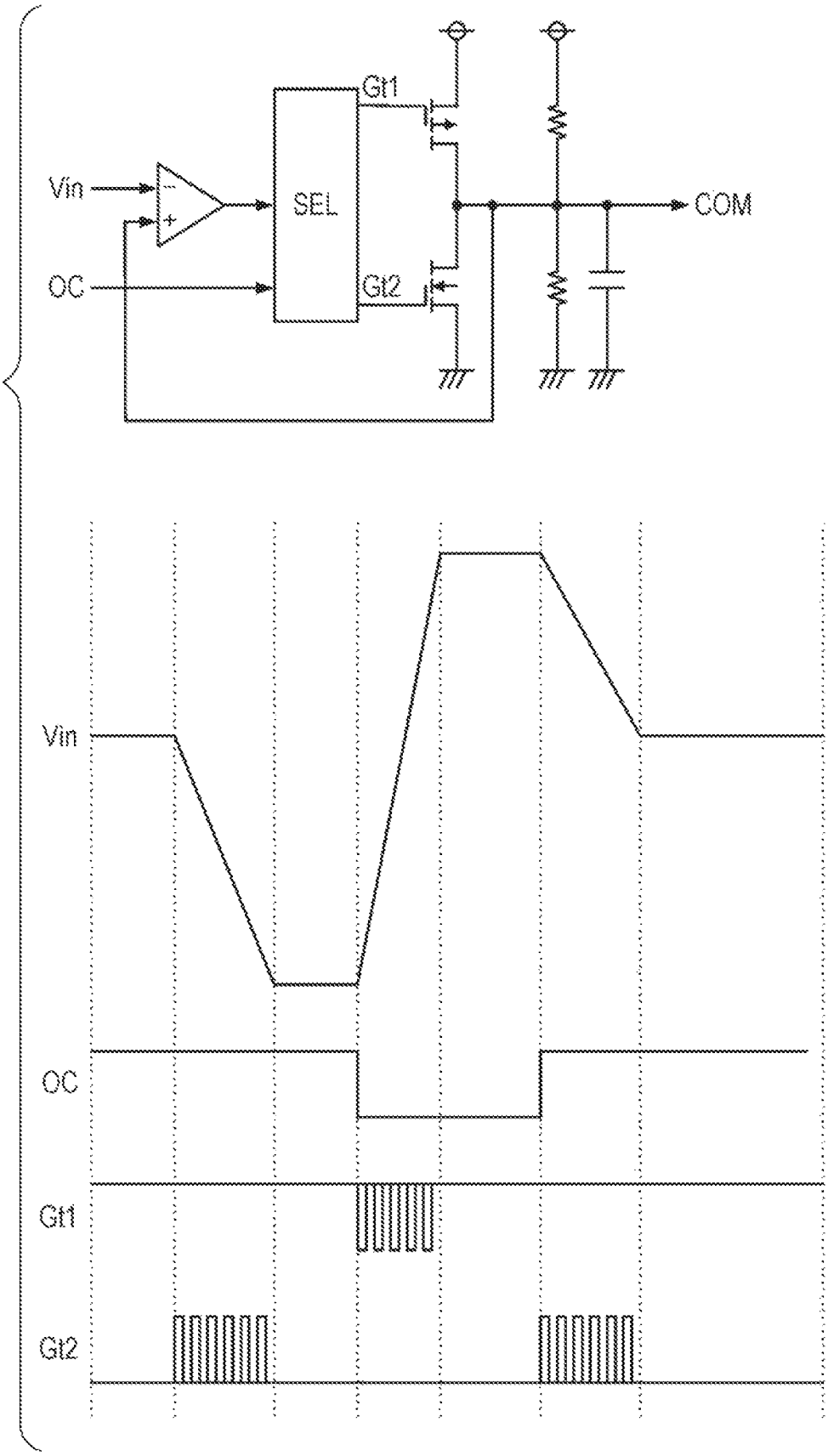
FIG. 19 is a diagram for describing a configuration and operation of a drive circuit in the related art.
Figure 20:
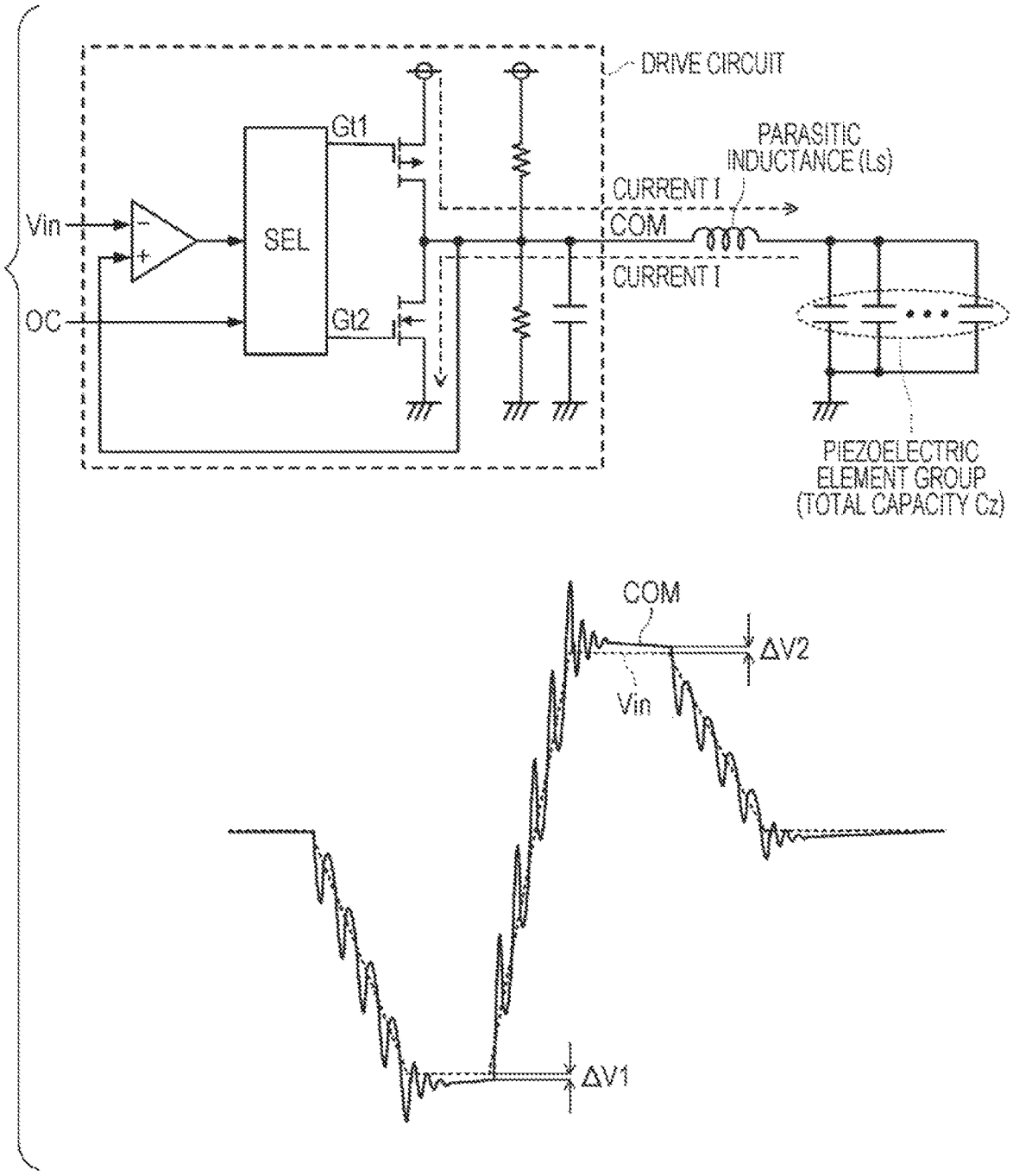
FIG. 20 is a diagram for describing a drive waveform at a time of heavy load drive by the drive circuit in the related art.

Moreover, in the drive circuit 50 according to the present embodiment, during a duration during which the voltage of the source drive signal ain (bin) rises or drops, if the voltage of the drive signal COMA (COMB) is in the first range, the transistors 56*a* and 57*a* are alternately set to be on. Furthermore, if the voltage of the drive signal COMA (COMB) is in the second range, the transistors 56*b* and 57*b* are alternately set to be on. Furthermore, if the voltage of the drive signal COMA (COMB) is in the third range, the transistors 56*c* and 57*c* are alternately set to be on. Furthermore, the voltage of the drive signal COMA (COMB) is in the fourth range, the transistors 56*d* and 57*d* are alternately set to be on. That is, when any one of the transistors 56*a* to 56*d* is set to be on and thus the voltage of the drive signal COMA (COMB) is higher than the voltage of the source drive signal ain, any one of the transistors 57*a* to 57*d* is promptly set to be on, the voltage of the drive signal COMA (COMB) drops. Furthermore, when any one of the transistors 57*a* to 57*d* is set to be on and thus the voltage of the drive signal COMA (COMB) is lower than the voltage of the source drive signal ain, any one of the transistors 56*a* to 56*d* is promptly set to be on, the voltage of the drive signal COMA (COMB) rises. Because of this, ripple is reduced when the voltage of the drive signal COMA (COMB) rises or drops. Therefore, with the liquid ejecting apparatus 1 according to the present embodiment, because a degradation in the drive signal COMA (COMB) is reduced, there is a concern that the precision of ejecting liquid from the ejecting section 600 will be reduced. It is noted that, in a drive circuit in the related art, which is illustrated in FIG. 19, a control signal OC is necessary in order to control which one of a high-side transistor and a low-side transistor is caused to operate for switching, and that in contrast, because the drive circuits 50 (50*a* and 50*b*) according to the present embodiment does not need this control signal, the configuration of the gate driver control circuit 53 is simplified and the control of the drive circuit 50 (50*a* and 50*b*) by the control section 111 is more simplified.

8. OPERATION AND EFFECT

As described above, in the liquid ejecting apparatus 1 according to the present embodiment, in the drive circuit 50*a* (50*b*), according to the selection signals S1 to S4, any one of the high-side transistors 56*a*, 56*b*, 56*c*, and 56*d* is set to be on and thus the voltage of the drive signal COMA (COMB) rises. Furthermore, any one of the low-side transistors 57*a*, 57*b*, 57*c*, and 57*d* is set to be on and thus the voltage of the drive signal COMA (COMB) drops. Then, the gate driver control circuit 53 generates the control signal VP and the control signal VN in such a manner that any one of the high-side transistors 56*a*, 56*b*, 56*c*, and 56*d* and any one of the low-side transistors 57*a*, 57*b*, 57*c*, and 57*d* are alternately set to be on according to the selection signals S1 to S4.

Specifically, based on a result of comparison between the voltage of the source drive signal ain (bin) and the voltage of the feedback signal ain2 (bin2), which results from feeding back the drive signal COMA (COMB), any one of the high-side transistors 56*a*, 56*b*, 56*c*, and 56*d* and any one of the low-side transistors 57*a*, 57*b*, 57*c*, and 57*d* are alternately set to be on, and thus the rise and drop in the voltage of the drive signal COMA (COMB) are alternately repeated. That is, when the voltage of the feedback signal ain2 (bin2) is higher than the voltage of the source drive signal ain (bin), any one of the low-side transistors 57*a*, 57*b*, 57*c*, and 57*d* is promptly set to be on and thus the voltage of the drive signal COMA (COMB) drops. Furthermore, when the voltage of the feedback signal ain2 (bin2) is lower than the voltage of the source drive signal ain (bin), any one of the high-side transistors 56*a*, 56*b*, 56*c*, and 56*d* is promptly set to be on and thus the voltage of the drive signal COMA (COMB) rises. Therefore, with the liquid ejecting apparatus 1 according to the present embodiment, because the similarity of the voltage of the drive signal COMA (COMB) to the voltage of the source drive signal ain (bin) is high, the precision of the waveform of the drive signal COMA (COMB) can be improved and the precision of ejecting liquid can be improved.

Particularly, in the present embodiment, during a duration (for example, the duration P4 in FIG. 16) during which the voltage of the source drive signal ain (bin) rises, any one of the high-side transistors 56*a*, 56*b*, 56*c*, and 56*d* and any one of the low-side transistors 57*a*, 57*b*, 57*c*, and 57*d* are alternately set to be on according to the selection signals S1 to S4. Therefore, when the voltage of the drive signal COMA (COMB) arises with the voltage of the source drive signal ain (bin), if the voltage of the feedback signal ain2 (bin2) is higher than the voltage of the source drive signal ain (bin), the voltage of the drive signal COMA (COMB) promptly stops rising and starts to drop. Furthermore, if the voltage of the feedback signal ain2 (bin2) is lower than the voltage of the source drive signal ain (bin), the voltage of the drive signal COMA (COMB) promptly stops dropping and starts to rise. Because of this, the ripple that occurs in the drive signal COMA (COMB) is reduced.

Furthermore, in the present embodiment, during a duration (for example, the durations P2 and P6 in FIG. 16) during which the voltage of the source drive signal ain (bin) drops, any one of the high-side transistors 56*a*, 56*b*, 56*c*, and 56*d* and any one of the low-side transistors 57*a*, 57*b*, 57*c*, and 57*d* are alternately set to be on according to the selection signals S1 to S4. Therefore, when the voltage of the drive signal COMA (COMB) drops with the voltage of the source drive signal ain (bin), if the voltage of the feedback signal ain2 (bin2) is lower than the voltage of the source drive signal ain (bin), the voltage of the drive signal COMA (COMB) promptly stops dropping and starts to rise. Furthermore, if the voltage of the feedback signal ain2 (bin2) is higher than the voltage of the source drive signal ain (bin), the voltage of the drive signal COMA (COMB) promptly stops rising and starts to drop. Because of this, a size of the ripple that occurs in the drive signal COMA (COMB) is reduced.

Furthermore, in the present embodiment, during a duration during which the voltage of the source drive signal ain (bin) is constant, any one of the high-side transistors 56*a*, 56*b*, 56*c*, and 56*d* and any one of the low-side transistors 57*a*, 57*b*, 57*c*, and 57*d* are alternately set to be on according to the selection signals S1 to S4. Therefore, when the voltage of the source drive signal ain (bin) is at a constant voltage, if the voltage of the feedback signal ain2 (bin2) is higher than the voltage of the source drive signal ain (bin), the voltage of the drive signal COMA (COMB) promptly stops rising and starts to drop. Furthermore, if the voltage of the feedback signal ain2 (bin2) is lower than the voltage of the source drive signal ain (bin), the voltage of the drive signal COMA (COMB) promptly stops dropping and starts to rise. Because of this, an error in a desired voltage in accordance with the voltage of the drive signal COMA (COMB) and the voltage of the source drive signal ain (bin) is reduced.

In this manner, with the liquid ejecting apparatus 1 according to the present embodiment, the similarity of the voltage of the drive signal COMA (COMB) to the voltage of the source drive signal ain (bin) is high, and the ripple and a voltage error in the drive signal COMA (COMB) is reduced. Because of this, the precision of the waveform of the drive signal COMA (COMB) can be improved and the precision of ejecting liquid can be improved.

Particularly, in the present embodiment, because the head 21 has 600 or more nozzle 651 that are arranged side by side at a density of 300 or more nozzles per one inch, the pitch Py (refer to FIG. 2) between the nozzles 651 is considerably small. Specifically, as described above, between two nozzle columns 650 that are provided in each nozzle plate 632, a relationship is established in which each of the nozzles 651 that are arranged side by side at a density of 300 or more nozzles per one inch is shifted by half the pitch Py in the sub-scanning direction Y, and thus it is possible that the printing at a high resolution of 600 dpi or more is performed. In the present embodiment, because the pitch Py between the nozzles 651 is considerably narrow, a horizontal width (a width in a direction along with the sub-scanning direction Y) of the cavity 631 that is provided in a manner that corresponds to the nozzle 651 has to be narrowed. The cavity 631 is difficult to transform in the upward-downward direction due to the narrow horizontal width thereof. In order to eject a given amount of ink through the nozzle 651, a vertical width (a width in a direction along the main scanning direction X) of the cavity 631 has to be increased sufficiently. Then, in order to eject the given amount of ink through the nozzle 651, an area (the horizontal width x the vertical width) of the cavity 631 is increased as much as the horizontal width is narrowed (as much as the pitch Py between the nozzles 651 is narrowed), and thus an area S of the piezoelectric element 60 increases. Moreover, in order to eject the given amount of ink through the nozzle 651, there is a need to increase an amount of displacement of the piezoelectric element 60. Because of this, a thickness d of the piezoelectric element 60 has to be decreased. To sum up, as the nozzles 651 are arranged side by side in higher density in order to perform the printing at a high resolution, an area S of the piezoelectric element 60 becomes greater and the thickness d becomes greater. Because of this, a capacity of the piezoelectric element 60 increases. As a result, there arises a situation where, because a load capacity Cz of the drive circuit 50*a* (50*b*) increases and an amount of load current I increases, an amount of noise, which is in proportion to the product (Ls×dI/dt) of parasitic inductance Ls of the cable 201 and wiring on the control substrate 100 or the head substrate 101 and a change rate of the load current I is superimposed onto the drive signal COMA (COMB) and high ripple occurs easily. When high ripple occurs on the drive signal COMA (COMB), not only the precision of ejecting liquid decreases, but the voltage of the drive signal COMA (COMB) also exceeds an allowable range in the worst case. As a result, a situation can also occur in which the amount of displacement of the piezoelectric element 60 increases unusually and thus the vibration plate 621 (refer to FIG. 4) is broken. In contrast, according to the present embodiment, during a duration during which the voltage of the source drive signal ain (bin) rises or drops, the similarity of the voltage of the drive signal COMA (COMB) to the voltage of the source drive signal ain (bin) is also high. Because of this, although the load capacity Cz increases, the size of the ripple that occurs on the drive signal COMA (COMB) can be kept small. In this manner, the liquid ejecting apparatus 1 according to the present embodiment achieves a remarkable effect particularly in a case where the printing at a high resolution is performed.

Furthermore, in a case where high-speed printing is performed in such a manner that the head 21 ejects ink (liquid) through the nozzle 651 at frequencies of 30 kHz or more, the periodicity Ta (the durations T1 and T2) of the drive signal COMA (COMB) has to be short. Because of this, each duration during which the voltage of the source drive signal ain (bin) is constant needs to be shortened. In contrast, according to the present embodiment, because the similarity of the voltage of the drive signal COMA (COMB) to the voltage of the source drive signal ain (bin) is high, although each duration during which the voltage of the source drive signal ain (bin) is constant is short, an error in a desired voltage in accordance with the voltage of the drive signal COMA (COMB) and the voltage of the source drive signal ain (bin) decreases reliably until when a voltage starts to rise or drop shortly thereafter. In this manner, the liquid ejecting apparatus 1 according to the present embodiment achieves a remarkable effect particularly in a case where high-speed printing is performed in such a manner that ink (liquid) is ejected at frequencies of 30 kHz or more.

Figure 17:
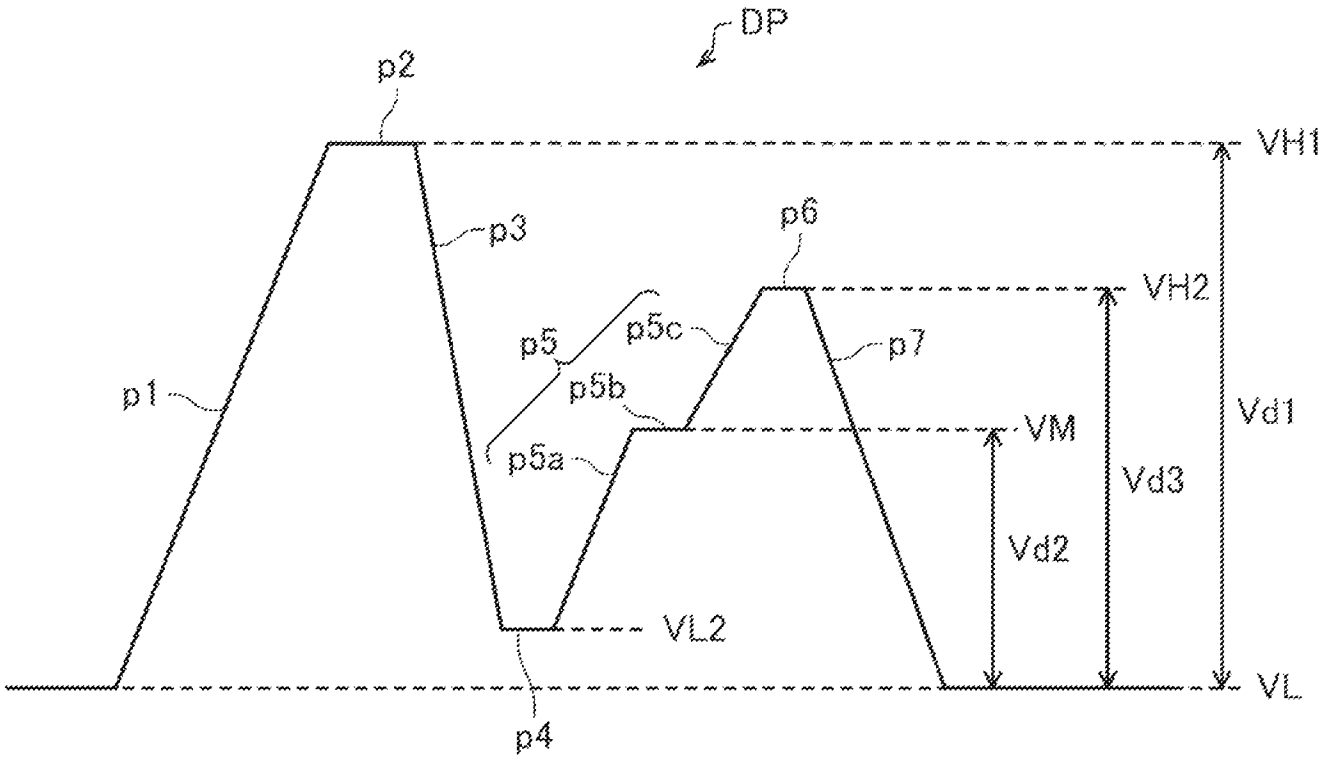
FIG. 17 is a schematic diagram illustrating an example of a waveform of the drive signal for ejecting high-viscosity liquid.
Figure 18:
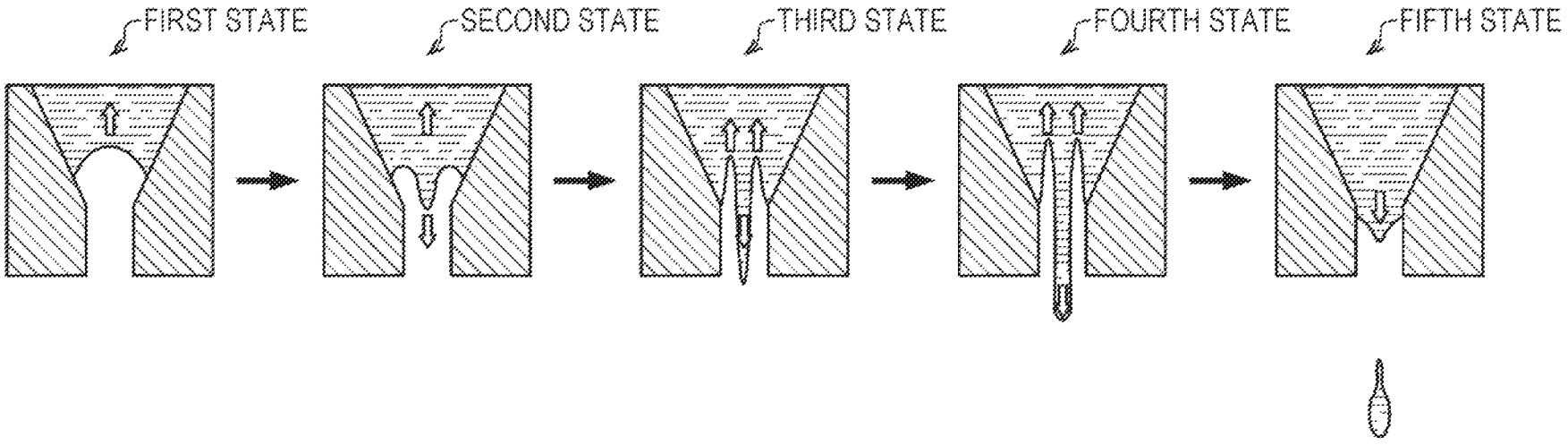
FIG. 18 is a schematic diagram illustrating a movement of a meniscus that results when ejecting the high-viscosity liquid.

Moreover, the liquid ejecting apparatus 1 according to the present embodiment achieves a remarkable effect in a case where high-viscosity liquid (high-viscosity ink) that, when ejected, has a rear end portion which extends like a tail is ejected. FIG. 17 is a schematic diagram illustrating an example of a waveform of the drive signal for ejecting the high-viscosity liquid. Furthermore, FIG. 18 is a schematic diagram illustrating a movement of a meniscus that results when ejecting the high-viscosity liquid.

A drive waveform DP that is illustrated in FIG. 17 is configured to include a first expansion element p1 in which to expand the cavity 631 which causes electric potential to rise from a reference electric-potential VL to the first expansion electric-potential VH1, a first hold element p2 in which to maintain an expanded state of the cavity 631 which is constant at the first expansion electric-potential VH1, a first contraction element p3 in which to contract the cavity 631 which causes the electric potential to drop from the first expansion electric-potential VH1 to a contraction electric-potential VL2 along a constant gradient, a second hold element p4 in which to maintain a contracted state of the cavity 631 which is constant at the contraction electric-potential VL2, a second expansion element p5 in which to expand the cavity 631 by causing the electric potential to rise from the contraction electric-potential VL2 to second expansion electric-potential VH2, a third hold element p6 in which to maintain the expanded state of the cavity 631 that is constant at the second expansion electric-potential VH2, and a second extraction element p7 in which to contract the cavity 631 by causing the electric potential to drop from the second expansion electric-potential VH2 to the reference electric-potential VL along a constant gradient. At this point, the second expansion element p5 in the drive waveform DP is configured from a first retraction element p5*a*, an intermediate maintenance element p5*b*, and a second retraction element p5*c*. The first retraction element p5*a* is a waveform element that causes electric potential to rise from the contraction electric-potential VL2 to first intermediate electric-potential VM and thus expands the cavity 631. The intermediate maintenance element p5*b* is a waveform element that is constant at the first intermediate electric-potential VM and is a waveform element that maintains the expanded state of the cavity 631 for a fixed time. The second retraction element p5*c* is a waveform element that causes electric potential to rise from the first intermediate electric-potential VM to the second expansion electric-potential VH2 and thus expands the cavity 631.

When the drive waveform DP is applied to the piezoelectric element 60, the following operation takes place. First, the cavity 631 is expanded to the extent to which liquid is not ejected by the first expansion element p1. Accordingly, the meniscus is retracted to the cavity 631 side (a first state in FIG. 18). It is noted that an arrow in FIG. 18 indicates a moving direction of the meniscus. The first state is always maintained over a duration during which the first hold element p2 is supplied. Thereafter, a volume of the cavity 631 is drastically contracted by the first contraction element p3. With the drastic contraction of the cavity 631, pressure is applied to liquid within the cavity 631, and thus the center portion of the meniscus that is susceptible to a change in pressure is pushed out toward the ejecting side and swells in the form of a pillar (a second state in FIG. 18). Then, the second state is maintained over a duration during which the second hold element p4 is supplied.

Thereafter, the cavity 631 is again expanded by the second expansion element p5. On this occasion, first, the cavity 631 is expanded by the first retraction element p5*a*. Accordingly, the vicinity of a liquid pillar section in the meniscus is drawn into the cavity 631 side. On the other hand, the liquid pillar section continues to move to the ejecting side by virtue of inertial force that occurs when the center portion of the meniscus is pushed out toward the ejecting side (a third state in FIG. 18). Subsequently, the third state is maintained by the intermediate maintenance element p5*b* for a fixed time. In the meantime, the liquid pillar section further expands toward the ejecting side. In the middle of growth of the liquid pillar section, the cavity 631 expands by the second retraction element p5*c*. Accordingly, the vicinity of the liquid pillar section in the meniscus is again drawn into the cavity 631 side (a fourth state in FIG. 18). Accordingly, the liquid pillar section is split while the vicinity thereof is drawn, and a portion that results from the split is ejected, as a droplet of liquid, through the nozzle 651 (a fifth state in FIG. 18). The fifth state is always maintained over a duration during which the third hold element p6 is supplied.

Then, subsequent to the third hold element p6, at a timing when the meniscus reacts against the ejection of a droplet of liquid and thus is drawn into the cavity 631, the cavity 631 is contracted by the second extraction element p7. Accordingly, the meniscus is suppressed from being drawn into the cavity 631 side, and thus, residual vibration of the meniscus is suppressed.

In this manner, the drive waveform DP that is illustrated in FIG. 17 includes four elements, the elements p2, p4, p5*b*, and p6, and thus, a tail of the rear end portion of high-viscosity liquid is cut off and liquid is ejected. Therefore, in the drive circuit 50*a* (50*b*), in order to generate the drive signal COMA (COMB) for ejecting high-viscosity liquid, the source drive signal ain (bin) may have a waveform having four or more durations during which a voltage is constant. Then, a waveform (a drive waveform) of the drive signal COMA (COMB) that corresponds to the waveform of the source drive signal ain (bin) is applied to the piezoelectric element 60, and thus the head 21 ejects liquid one time through the nozzle 651. In this case, many durations during which the voltage of the source drive signal ain (bin) is constant are present. In contrast, according to the present embodiment, because the similarity of the voltage of the drive signal COMA (COMB) to the voltage of the source drive signal ain (bin) is high, although each duration during which the voltage of the source drive signal ain (bin) is constant is short, an error in a desired voltage in accordance with the voltage of the drive signal COMA (COMB) and the voltage of the source drive signal ain (bin) decreases reliably until when a voltage starts to rise or drop shortly thereafter. In this manner, the liquid ejecting apparatus 1 according to the present embodiment achieves a remarkable effect particularly in a case where high-viscosity liquid is ejected.

9. MODIFICATION EXAMPLES

The above-described embodiment, the drive circuits 50*a* and 50*b* are provided on the control substrate 100, but may be provided on the head substrate 101 and may be provided on a substrate (a relay substrate) that is different from the control substrate 100 and the head substrate 101.

Furthermore, in the above-described embodiment, two drive circuits (the drive circuits 50*a* and 50*b*) are present. However, one drive circuit may be present and three or more drive circuits may be present.

Furthermore, in the above-described embodiment, in the drive circuits 50*a* and 50*b*, a range from a maximum power source voltage V5 to a maximum power source voltage V1 is divided into four ranges, the first range to the fourth range, and thus four gate drives 55*a* to 55*d* are caused to operate. However, the number of ranges (the number of gate drivers) for dividing the power source voltage may be 3 or less, or may be 5 or more without being limited to 4.

Furthermore, in the above-described embodiment, the waveform of the drive signal COMA and the waveform of the drive signal COMB are combined and, thus, the drive signal VOUT that has the drive waveforms which correspond to the large-sized dot, the middle-sized dot, the small-sized dot, and the non-recording, respectively, is generated and is applied to each piezoelectric element 60, but a method of generating the drive signal VOUT that is to be applied to each piezoelectric element 60 is not limited to this, and various methods are applicable. For example, at each printing periodicity, any one of a drive signal COMA that has a drive waveform for the large-sized dot, a drive signal COMB that has a drive waveform for the middle-sized dot, a drive signal COMC that has a drive waveform for the small-sized dot, and a drive signal COMD that has a drive waveform for the non-recording is selected, and thus a drive signal VOUT may be generated that has drive waveforms which correspond to the large-sized dot, the middle-sized dot, the small-sized dot, and the non-recording, respectively. Furthermore, for example, at each printing periodicity, two drive waveforms for the middle-sized dot, one drive waveform for the middle-sized dot, one drive waveform for the small-sized dot, or one drive waveform for the non-recording (for the minute vibration) is selected from one drive signal COM that has two drive waveforms for the middle-sized dot, one drive waveform for the small-sized dot, and one waveform for the non-recording (for minute vibration), and thus a drive signal VOUT may be generated that has drive waveforms which correspond to the large-sized dot, the middle-sized dot, the small-sized dot, and the non-recording, respectively.

Furthermore, in the above-described embodiment, as an example of the liquid ejecting apparatus, the ink jet printer that is a serial scanner type (a serial printer type), in which the liquid ejecting head moves and performs printing on a printing medium, is given, but it is also possible that the invention finds application in an ink jet printer that is a line head type, in which printing is performed on the printing medium without the liquid ejecting head moving.

The present embodiment and the modification examples are described above, but the invention is not limited to the present embodiment or the modification examples. It is possible that various modifications to the invention are implemented within the scope that does not depart from the gist thereof. For example, it is also possible that the above-described embodiment is suitably combined with each of the modification examples.

The invention includes substantially the same configuration (for example, a configuration that has the same function, the same way, and the same result, or a configuration that has the same object and the same effect) as described in the embodiment. Furthermore, the invention includes a configuration in which an unsubstantial portion of the configuration that is described in the embodiment is replaced. Furthermore, the invention includes a configuration that achieves the same operation and effect as the configuration that is described in the embodiment, or a configuration that can accomplish the same object. Furthermore, the invention includes a configuration that results from adding a well-known technology to the configuration that is described in the embodiment.

What is claimed is:

1. A drive circuit that generates a drive signal which is to be applied to a capacitive load, the drive circuit comprising:

a comparator that compares a voltage of a source drive signal which is a source of the drive signal and a voltage of a feedback signal which is a signal that results from feeding back the drive signal;

a transistor pair that includes a high-side transistor and a low-side transistor and outputs the drive signal; and a control signal generation circuit into which an output signal of the comparator is input and which generates a first control signal that controls switching operation of the high-side transistor and a second control signal that controls switching operation of the low-side transistor, wherein the control signal generation circuit includes an OR circuit which has a first input terminal and a second input terminal that each receive the output signal of the comparator, wherein the OR circuit outputs the first control signal based on the output signal of the comparator as received at the first input terminal and the second input terminal, and an AND circuit which has a third input terminal and a fourth input terminal that each receive the output signal of the comparator, wherein the AND circuit outputs the second control signal based on the output signal of the comparator as received at the third input terminal and the fourth input terminal, and wherein a logical threshold at which the OR circuit responds to changes in the output signal of the comparator is lower than a logical threshold at which the AND circuit responds to changes in the output signal of the comparator.

2. The drive circuit according to claim 1, wherein during a duration during which the voltage of the source drive signal rises, the high-side transistor and the low-side transistor are alternately set to be on.

3. The drive circuit according to claim 1, wherein during a duration during which the voltage of the source drive signal drops, the high-side transistor and the low-side transistor are alternately set to be on.

4. The drive circuit according to claim 1, wherein during a duration during which the voltage of the source drive signal is constant, the high-side transistor and the low-side transistor are alternately set to be on.

5. A system comprising the drive circuit according to claim 1 and further comprising a head that ejects liquid through nozzles with displacement of a piezoelectric element, wherein the head includes 600 or more of that nozzles that are arranged side by side at a density of 300 or more nozzles per one inch.

6. The drive circuit according to claim 5, wherein the head ejects the liquid through the nozzles at frequencies of 30 or more kHz.

7. The drive circuit according to claim 5, wherein the source drive signal has a waveform that has four or more durations during which a voltage is constant, and wherein the head ejects the liquid one time by applying a drive waveform which corresponds to the waveform of the source drive signal to the piezoelectric element.

* * * * *